US010913109B2

(12) United States Patent
Oh et al.

(10) Patent No.: US 10,913,109 B2
(45) Date of Patent: Feb. 9, 2021

(54) VERTICAL SEMI-CONTINUOUS CASTING EQUIPMENT AND VERTICAL SEMI-CONTINUOUS CASTING METHOD

(71) Applicant: POSCO, Pohang-si (KR)

(72) Inventors: Kyung Shik Oh, Pohang-si (KR); Young Hoon Kang, Busan (KR); Joo Dong Lee, Pohang-si (KR); Ki Hwan Joung, Gwangyang-si (KR); Un Kwan Cho, Pohang-si (KR)

(73) Assignee: POSCO, Pohang-si (KR)

( * ) Notice: Subject to any disclaimer, the term of this patent is extended or adjusted under 35 U.S.C. 154(b) by 239 days.

(21) Appl. No.: 15/760,451

(22) PCT Filed: Oct. 23, 2015

(86) PCT No.: PCT/KR2015/011283
§ 371 (c)(1),
(2) Date: Mar. 15, 2018

(87) PCT Pub. No.: WO2017/047863
PCT Pub. Date: Mar. 23, 2017

(65) Prior Publication Data

US 2018/0250736 A1 Sep. 6, 2018

(30) Foreign Application Priority Data

Sep. 16, 2015 (KR) ..... 10-2015-0130729

(51) Int. Cl.
*B22D 11/128* (2006.01)
*B22D 11/041* (2006.01)
(Continued)

(52) U.S. Cl.
CPC ..... *B22D 11/1281* (2013.01); *B22D 11/041* (2013.01); *B22D 11/053* (2013.01);
(Continued)

(58) Field of Classification Search
CPC ..... B22D 11/128; B22D 11/1281; B22D 11/1285; B22D 11/1287; B22D 11/1288;
(Continued)

(56) References Cited

U.S. PATENT DOCUMENTS 2,740,177 A * 4/1956 Smart, Jr. ..... B22D 11/141 164/464
4,889,178 A * 12/1989 Nigris ..... B22D 11/1281 164/448
(Continued)

FOREIGN PATENT DOCUMENTS

CN 101516545 8/2009
DE 3027789 2/1982
(Continued)

OTHER PUBLICATIONS

Machine Translation of Yamaguchi (JP 63-40656 A, published Feb. 22, 1988, cited in IDS filed May 7, 2019). (Year: 1988).*
(Continued)

*Primary Examiner* — Kevin E Yoon
*Assistant Examiner* — Jacky Yuen
(74) *Attorney, Agent, or Firm* — Cantor Colburn LLP

(57) ABSTRACT

Provided is vertical semi-continuous casting equipment including a guide device disposed under the mold to support the slab drawn from the plate, the guide device being configured to guide the descending of the slab. The guide device includes first and second guide parts including a plurality of guide rolls respectively disposed on both sides of a moving path of the plate under the mold to support the slab moving by the plate and guide the movement of the slab and a braking unit connected to each of the guide rolls to apply braking force to the guide roll that rotates by the movement of the slab. In accordance with an exemplary embodiment, the slab having the length longer than that of the slab in
(Continued)

accordance with the related art may stably descend, the shaking of the slab may be prevented, and the casting speed may be stabilized.

11 Claims, 16 Drawing Sheets

(51) Int. Cl.
*B22D 11/12* (2006.01)
*B22D 11/14* (2006.01)
*B22D 11/053* (2006.01)
*B22D 11/124* (2006.01)

(52) U.S. Cl.
CPC ..... *B22D 11/12* (2013.01); *B22D 11/128* (2013.01); *B22D 11/1245* (2013.01); *B22D 11/14* (2013.01); *B22D 11/141* (2013.01)

(58) Field of Classification Search
CPC ... B22D 11/081; B22D 11/083; B22D 11/085; B22D 11/04; B22D 11/041; B22D 11/14; B22D 11/141
See application file for complete search history.

(56) References Cited

U.S. PATENT DOCUMENTS

| | | | |
|---|---|---|---|
| 8,689,856 | B1 | 4/2014 | Jacques et al. |
| 2013/0333473 | A1 | 12/2013 | Cestari et al. |

FOREIGN PATENT DOCUMENTS

| | | | | |
|---|---|---|---|---|
| DE | 3621234 | A1 * | 1/1988 | ..... B22D 11/1281 |
| EP | 0301242 | | 2/1989 | |
| JP | 56084159 | | 7/1981 | |
| JP | 59007469 | | 1/1984 | |
| JP | 63040656 | | 2/1988 | |
| JP | 07144255 | | 6/1995 | |
| JP | 11000701 | | 1/1999 | |
| JP | 2000140906 | | 5/2000 | |
| KR | 20090021181 | | 2/2009 | |
| KR | 20100099133 | | 9/2010 | |
| KR | 20110074153 | | 6/2011 | |
| KR | 101175994 | | 8/2012 | |
| KR | 101197850 | | 11/2012 | |
| KR | 101272712 | | 6/2013 | |
| KR | 20140113040 | | 9/2014 | |
| WO | WO-2016131437 | A2 * | 8/2016 | ..... B22D 11/141 |

OTHER PUBLICATIONS

Machine Translation of Lee et al (KR 2011-0074153A, published Jun. 30, 2011, cited in IDS filed Mar. 15, 2018). (Year: 2011).*
Brazilian Office Action—Brazilian Application No. BR112018005160-8 dated Sep. 24, 2019, citing US2013333473 and Fachberger, et al.
Fachberger, et al., SAW-RFID and Temperature Monitoring of Slide Gate Plates, IEEE SENSORS, 2009, pp. 1514-1517.
European Search Report—European Application No. 15904193.8, issued on Oct. 25, 2018, citing EP 0 301 242, DE 30 27 789 and KR 2011 0074153.
PCT Written Opinion—PCT/KR2015/011283 dated Mar. 29, 2018, citing KR 10-2011-0074153, KR 10-2010-0099133, KR 10-2009-0021181, KR 10-1175994 and KR 10-1197850.
Chinese Office Action—Chinese Application No. 201580083184.5 dated Apr. 11, 2019, citing EP 0301242, KR 20110074153, JP H07144255, CN 101516545, JP S6340656, DE 3027789 and KR 20140113040.
Chinese Office Action—Chinese Application No. 201580083184.5 dated Dec. 4, 2019, citing EP 0301242, US 8689856 and KR 20110074153.
Japanese Office Action—Japanese Application No. 2018-512629 dated Feb. 26, 2019, citing JP 07-144255, JP 63-040656, JP 56-084159, DE 3027789 and JP 59-007469.
International Search Report—PCT/KR2015/011283 dated May 13, 2016.

* cited by examiner

4100a : 4110a, 4120a
4100b : 4110b, 4120b

VERTICAL SEMI-CONTINUOUS CASTING EQUIPMENT AND VERTICAL SEMI-CONTINUOUS CASTING METHOD

BACKGROUND

The present disclosure relates to vertical semi-continuous casting equipment and a vertical semi-continuous casting method using the same, and more particularly, to vertical semi-continuous casting equipment that is capable of improving productivity and recovery and a method semi-continuous casting method using the same.

In casting of a slab having a thick thickness (about 400 mm to about 1,000 mm), since it is difficult to cast the slab by using general curved casting equipment, the slab may be cast by using vertical casting equipment, but not using the curved casting equipment. However, when a slab having a very thick thickness is cast, it takes a very long time to completely solidify the slab. Thus, in case of continuous casting, there is a limitation in that a vertical part of the equipment has a very long length. Thus, a vertical semi-continuous casting method, in which casting is finished after casting a slab S having a predetermined length, and then a slab S is cast through the next charging, is used.

As shown in FIG. 1, the vertical semi-continuous casting equipment using the vertical semi-continuous casting method includes a tundish T receiving molten steel supplied from a ladle L, a mold M continuously receiving the molten steel from the tundish T to solidify the molten steel, an elevatable plate 10 inserted into the mold M during the casting and descending while supporting the slab S that is solidified in the mold M to draw the slab S from the mold M, and a foot roll 30 assisting and guiding the drawing of the slab S from the mold M. Also, the vertical semi-continuous casting equipment includes a heater disposed above the mold to heat an upper portion (top portion) of the slab S, thereby to minimize a pipe defect at the upper portion of the slab S.

In accordance with the casting method using the above-described vertical semi-continuous casting equipment, the molten steel is injected into the mold M in a state in which the plate 10 is inserted to cover a lower opening of the mold M. The molten steel supplied into the mold M is solidified by cooling water flowing through the inside of a wall of the mold M. Here, when the plate 10 vertically descends, the slab S is drawn from the mold M. As described above, when the injection of the molten steel into the mold M and the descending of the plate 10 are continuously performed, the slab S having the predetermined length may be drawn from the mold S by the descending plate 10. Also, when the slab S having the predetermined length is cast, the casting is finished, and the upper portion (top portion) of the slab S is heated by the heater.

In accordance with the vertical semi-continuous casting equipment, the casting is finished after the casting through one charging (or one heating) is performed, and then, casting through the next charging is prepared. That is, the slab S is cast as much as an amount of molten steel supplied from one ladle S to the tundish T, and then, the casting is finished. Thus, since casting through multi charging by supplying the molten steel from a plurality of ladles L to the tundish is not performed, productivity and recovery of the slab S may be deteriorated.

SUMMARY

The present disclosure provides vertical semi-continuous casting equipment that is capable of improving productivity and recovery and a vertical semi-continuous casting method using the same.

The present disclosure also provide vertical semi-continuous casting equipment that is capable of vertically casting a slab having a length greater than that of a slab in accordance with the related art and a vertical semi-continuous casting method using the same.

In accordance with an exemplary embodiment, vertical semi-continuous casting equipment includes: a mold configured to cool molten steel, thereby casting a slab; an elevatable plate descending while supporting a lower portion of the slab that is cast in the mold to draw the slab from the mold in a state in which the slab is disposed in a direction perpendicular to the ground; and a guide device disposed under the mold to support the slab drawn from the plate, the guide device being configured to guide the descending of the slab, wherein the guide device includes first and second guide parts including: a plurality of guide rolls respectively disposed on both sides of a moving path of the plate under the mold to support the slab moving by the plate and guide the movement of the slab; and a braking unit connected to each of the guide rolls to apply braking force to the guide roll that rotates by the movement of the slab.

Each of the first and second guide parts may include a roll driving unit connected to each of the guide rolls to allow the guide roll to move forward or backward toward the moving path of the slab and the plate.

The roll driving unit may include: a support block connected to an end of the guide roll; and a horizontal moving part connected to the support block to apply forward moving force and backward moving force.

Each of the first and second guide parts may include a plurality of nozzles disposed between the plurality of guide rolls that are vertically arranged to inject cooling water to the slab.

The vertical semi-continuous casting equipment may further include a movement guide device disposed under the mold to extend in the direction perpendicular to the ground and including a guide body having an inner space along which the slab and the plate move in the direction perpendicular to the ground, the movement guide device being configured to guide the movement of the slab and the plate, wherein the first and second guide parts may be disposed on one side and the other side of the movement guide device, respectivley.

First openings vertically arranged to be spaced apart from each other may be defined in one surface of the guide body facing the first guide part, second openings vertically arranged to be spaced apart from each other may be defined in the other surface of the guide body facing the second guide part, the plurality of guide rolls of the first guide part may be arranged to correspond to the first openings, the plurality of guide rolls moving forward and backward to pass through the first openings by a horizontal driving part of the first guide part; and the plurality of guide rolls of the second guide part may be arranged to correspond to the second openings, the plurality of guide rolls moving forward and backward to pass through the second openings by a horizontal driving part of the second guide part.

The guide body may include: first and second support members vertically extending in a direction crossing positions of the plurality of first and second openings, the first and second support members being disposed to face each other; a plurality of first frames extending in a direction crossing the extension direction of the first and second support members to connect the first support member to the second support member at one side of the first and second support members, the plurality of first frames being arranged to be spaced apart from each other in the extension direction of the first and second support members; and a plurality of second frames extending in a direction crossing the extension direction of the first and second support members to connect the first support member to the second support member at the other side of the first and second support members, the plurality of second frames being arranged to be spaced apart from each other in the extension direction of the first and second support members, wherein a spaced space between the first frames may be defined as the first opening, and a spaced space between the second frames may be defined as the second opening.

The movement guide device may include a guide member disposed on an inner surface of each of the first and second support members of the guide body to extend along the extension direction of each of the first and second support members.

The vertical semi-continuous casting equipment may further include a moving cart disposed in the inner space of the guide body to support the plate, the moving cart being elevated along the extension direction of the guide body.

The vertical semi-continuous casting equipment may further include a plate moving device connected to the moving cart to elevate the moving cart.

The moving cart may include: a cart body on which the plate is seated on an upper portion thereof; a pair of rotatable first sheaves disposed to be connected both side surfaces of the cart body; a pair of rotatable second sheaves disposed on one sides of the pair of first sheaves, respectivley; and first and second gliding parts mounted on both side surfaces of the cart body, the first and second gliding parts being configured to be glided along the first and second guide members of the movement guide device.

The plate moving device may include: a rotatable first winch disposed above the outside of the movement guide device; a first wire wound to connect the first sheaves of the moving cart to the first winch; a rotatable first drum around which the first wire wound around the first winch is wound; a first motor connected to the first drum to rotate the first drum; a rotatable second winch disposed under the outside of the movement guide device; a second wire wound to connect the second sheaves of the moving cart to the second winch; a rotatable second drum around which the second wire wound around the second winch is wound; and a second motor connected to the second drum to rotate the second drum.

The vertical semi-continuous casting equipment may further include: an unloading device disposed outside the first frame of the guide body to receive the cast slab, thereby unloading the slab; and a separation device disposed outside the second frame to face the unloading device, the separation device being configured to push the cast slab disposed in the guide body toward the unloading device, thereby separating the slab from the plate.

The lowermost first frame of the plurality of first frames that are arranged to be spaced apart from each other in the extension direction of the first and second support members may be disposed at a height higher than that of the unloading device to allow a region of the guide body, which is under the lowermost first frame, to be defined as a space in which the cast slab is unloaded from the guide body.

The unloading device may receive the slab that is in the vertical state from the plate to rotate to a horizontal state.

The vertical semi-continuous casting equipment may further include a first stirring device disposed around the outside of the mold to stir the molten steel within the mold.

The vertical semi-continuous casting equipment may further include a second stirring device disposed around an upper portion of the movement guide device or in the guide roll outside the movement guide device to stir non-solidified molten steel of the slab during or after the casting.

The vertical semi-continuous casting equipment may further include a heating device that is movable between the mold and the movement guide device, wherein, when a top portion of the slab within the movement guide device ascends to be disposed between the mold and the movement guide device after the drawing of the slab from the mold is finished, the heating device may heat the top portion of the slab.

In accordance with another exemplary embodiment, a vertical semi-continuous casting method includes: allowing a plate to ascend, thereby closing a lower opening of a mold; supplying molten steel into the mold to cool the molten steel in the mold; allowing the plate to descend in a direction perpendicular to the ground, thereby continuously drawing a slab from the mold; and oscillating the mold, wherein the continuously drawing of the slab includes: allowing the slab to descend between a plurality of first guide rolls arranged in the direction perpendicular to the ground at a lower side of the mold and a plurality of second guide rolls disposed to face the plurality of first guide rolls at the lower side of the mold; and applying braking force to each of the plurality of first guide rolls and the plurality of second guide rolls according to a casting speed while the slab descends between the plurality of first guide rolls and the plurality of second guide rolls.

The vertical semi-continuous casting method may further include injecting cooling water to the slab while the slab moves between the first guide rolls and the second guide rolls.

Before the plate descends, each of the first and second guide rolls may horizontally move to adjust a distance between the first and second guide rolls according to a thickness of the slab to be cast so that the first guide rolls contact one surface of the slab, and the second guide rolls contact the other surface of the slab.

A movement guide device having an inner space and extending in the direction perpendicular to the ground may be disposed under the mold, first and second openings may be defined in one surface and the other surface of the movement guide device to correspond to the plurality of first and second guide rolls, respectively, and before the slab is drawn from the mold, the first guide rolls may horizontally move to pass through the first opening according to the thickness of the slab, and the second guide rolls may horizontally move to pass through the second opening according to the thickness of the slab.

The slab continuously drawn by the plate may move to pass through the inside of the movement guide device.

The vertical semi-continuous casting method may further include operating the first stirring device disposed around the outside of the mold to stir the molten steel within the mold.

The vertical semi-continuous casting method may further include stirring non-solidified molten steel of the slab that moves into the movement guide device during the casting or is being solidified after the casting by using a second stirring device disposed on each of one side of the first guide roll and the other side of the second guide roll.

When the casting of the slab is finished, a heating device may move between the mold and the first and second guide rolls, and a top portion of the slab may ascend to be disposed between the first and second guide rolls and be heated by using the heating device.

BRIEF DESCRIPTION OF THE DRAWINGS

Exemplary embodiments can be understood in more detail from the following description taken in conjunction with the accompanying drawings, in which.

DETAILED DESCRIPTION OF EMBODIMENTS

Hereinafter, specific embodiments will be described in detail with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present invention to those skilled in the art.

Figure 1:
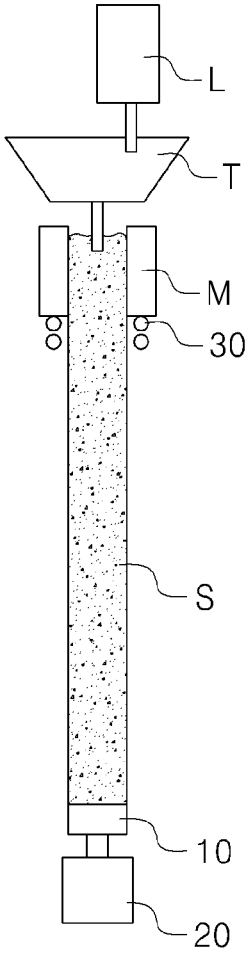
FIG. 1 Prior art
FIG. 1 is a conceptual view of general vertical semi-continuous casting equipment.
Figure 2:
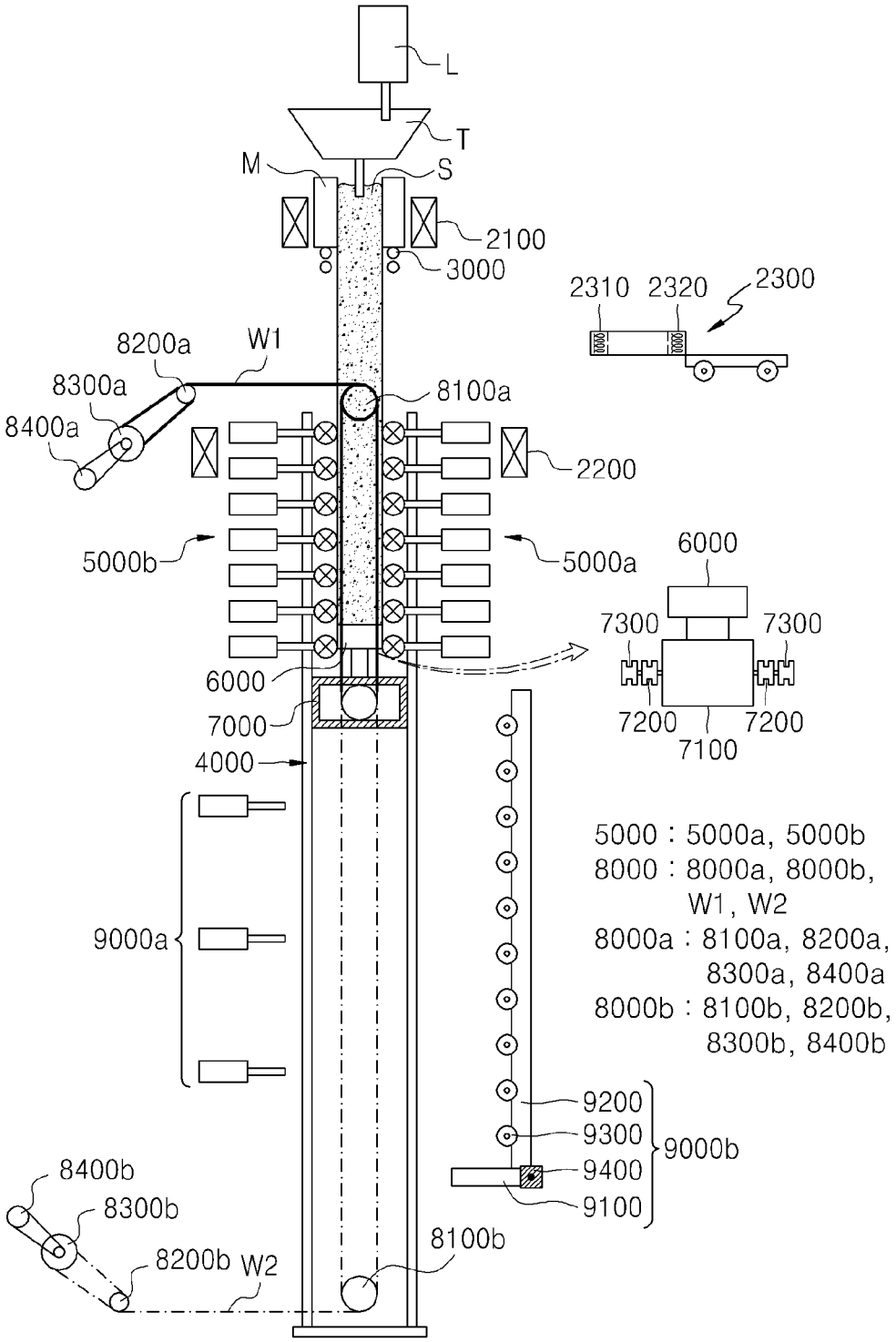
FIG. 2 is a conceptual view of vertical semi-continuous casting equipment in accordance with an exemplary embodiment.
Figure 3:
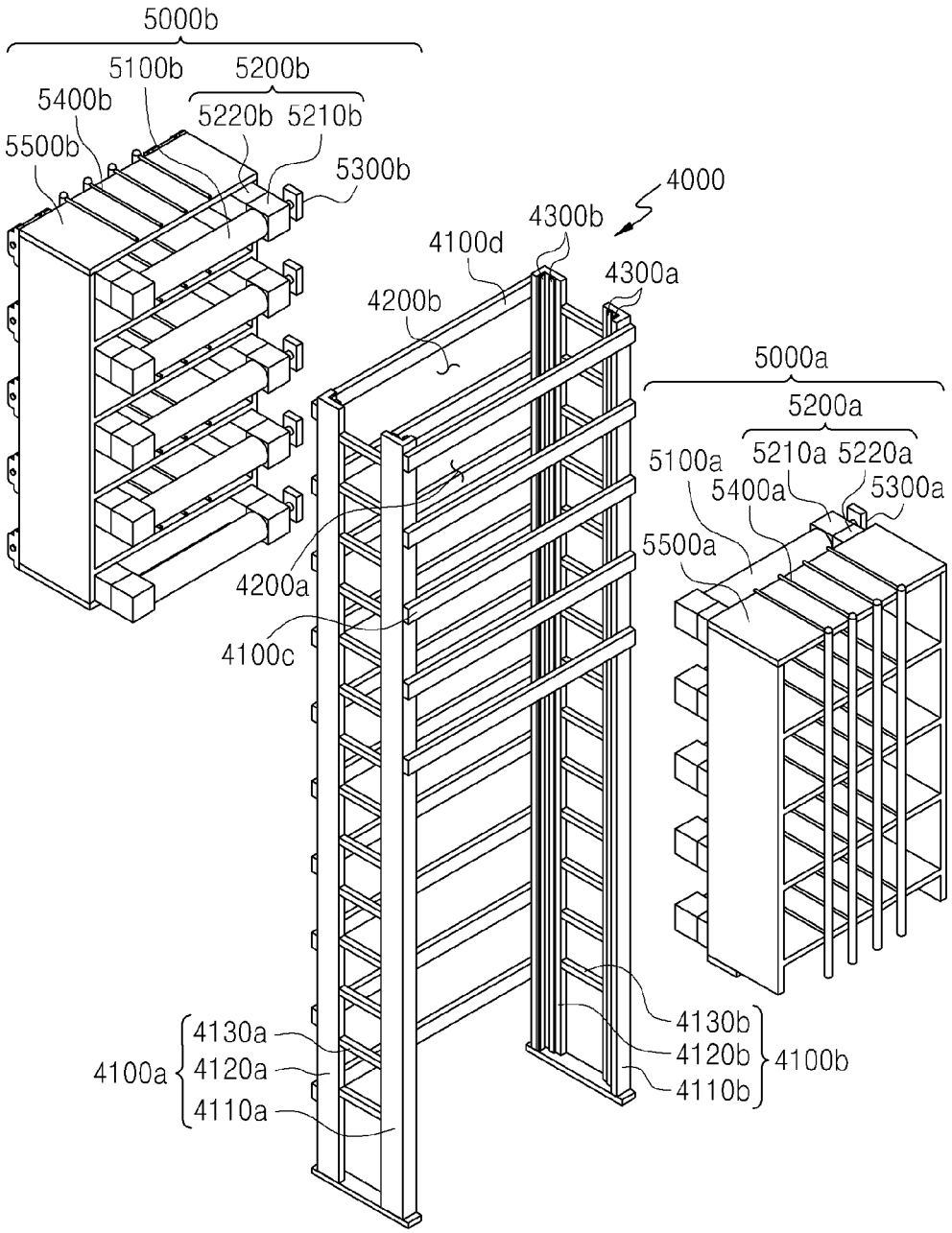
FIGS. 3 and 4 are solid views of a movement guide device and a guide device in accordance with an exemplary embodiment.
Figure 4:
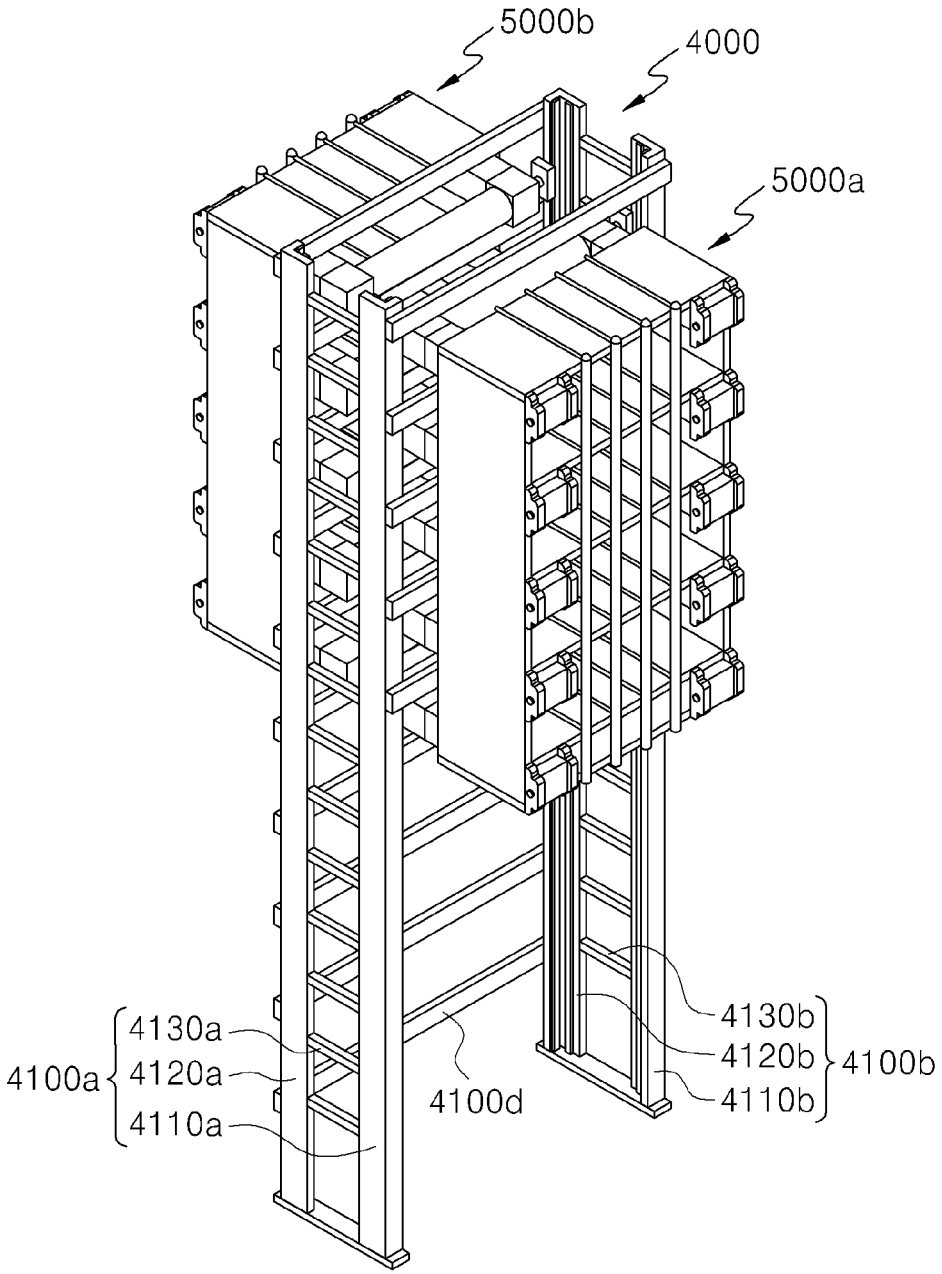
Figure 5:
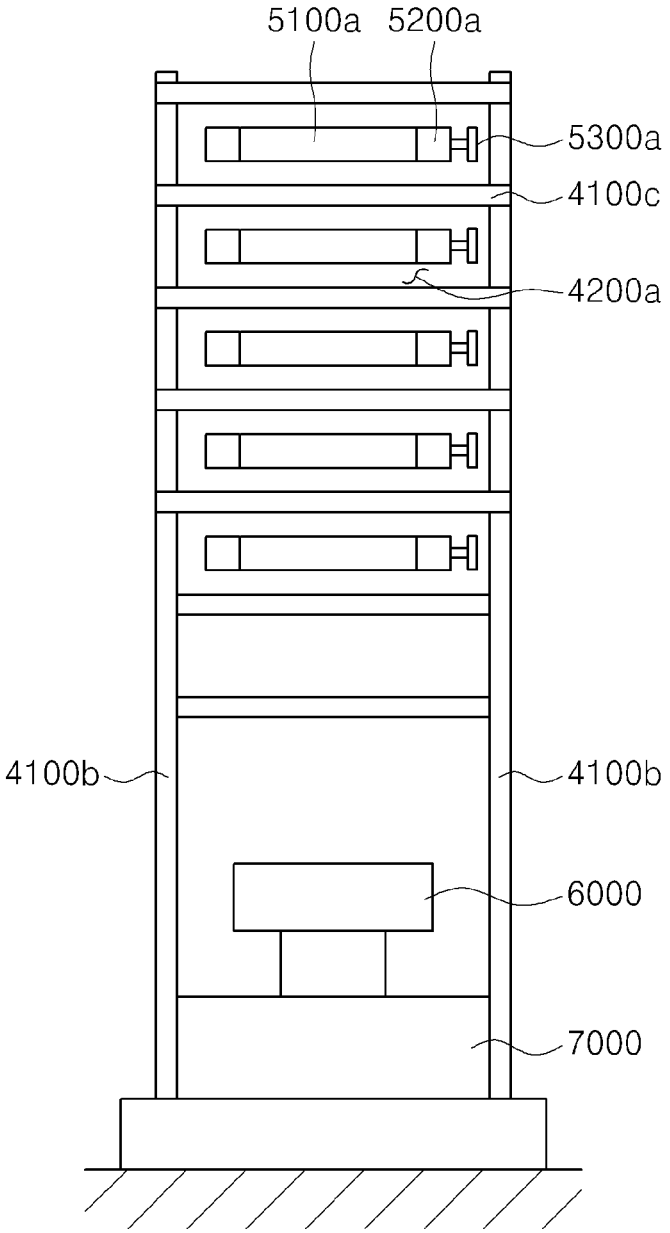
FIG. 5 is a schematic view illustrating a state in which a guide roll of the guide device is disposed to correspond to a spaced space between a plurality of frames in a direction in which the plurality of frames of the movement guide device are disposed.
Figure 6:
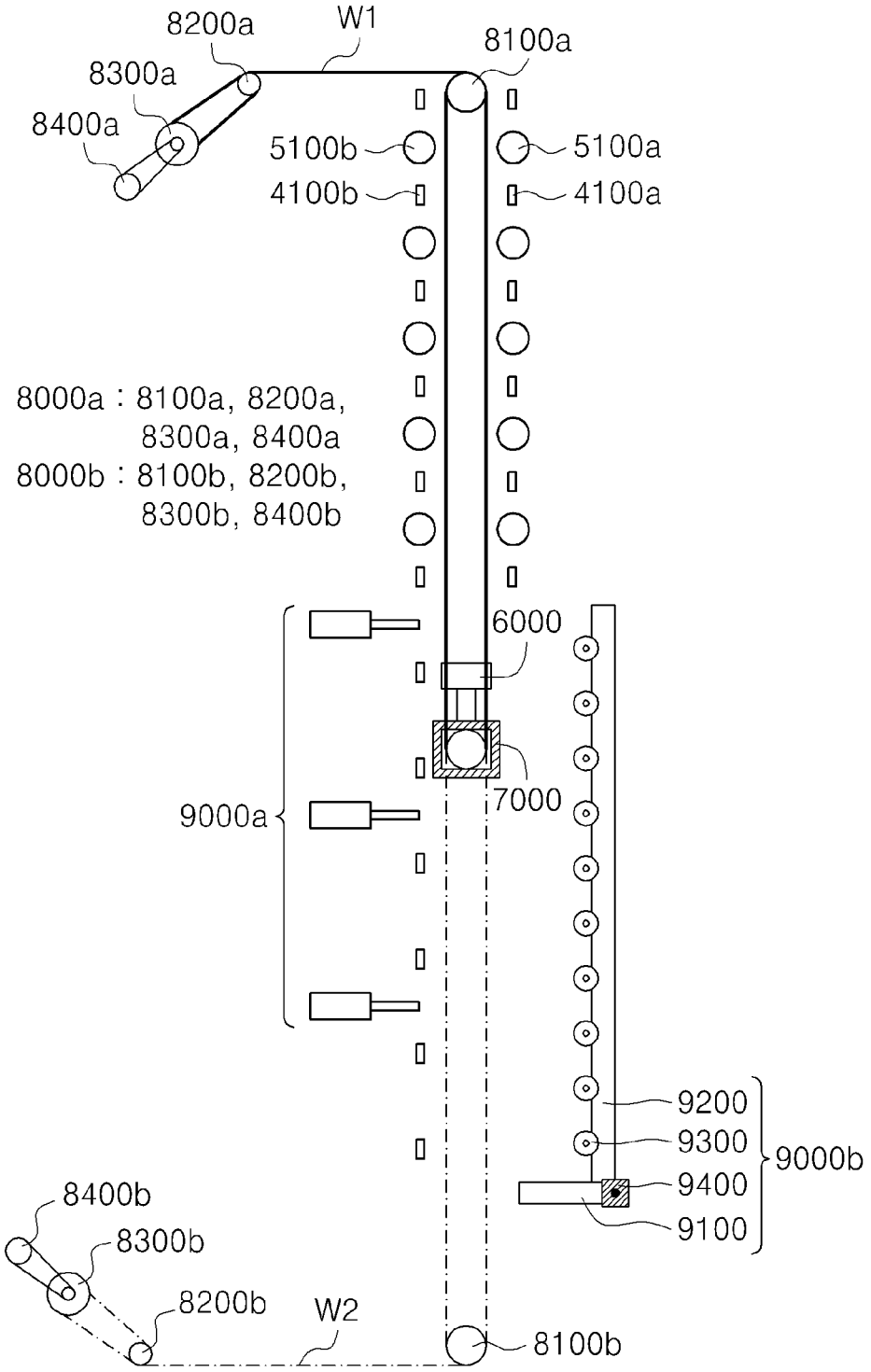
FIG. 6 is a schematic view illustrating a state in which the guide roll and a nozzle of the guide device are disposed to correspond to the spaced space between the plurality of frames in a direction in which first and second guide members of the movement guide device are disposed.
Figure 7:
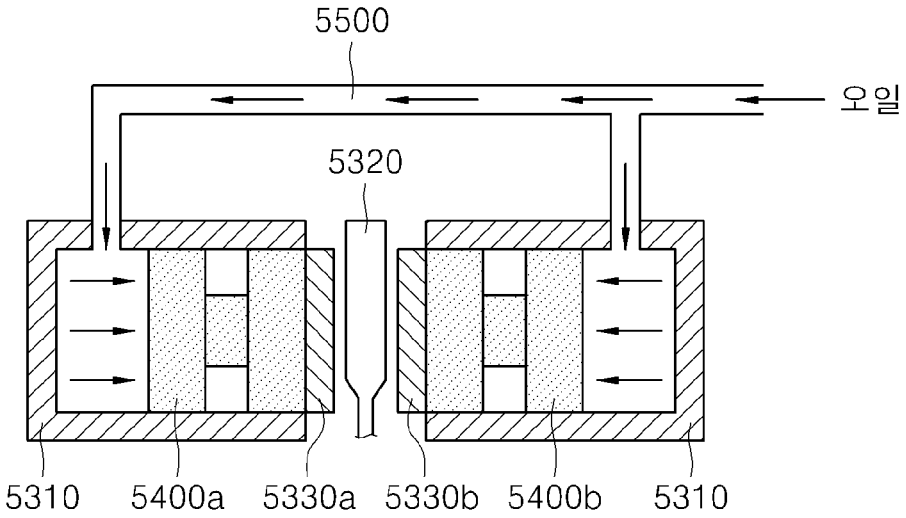
FIG. 7 is a view for a blocked braking unit in accordance with an exemplary embodiment.
Figure 8:
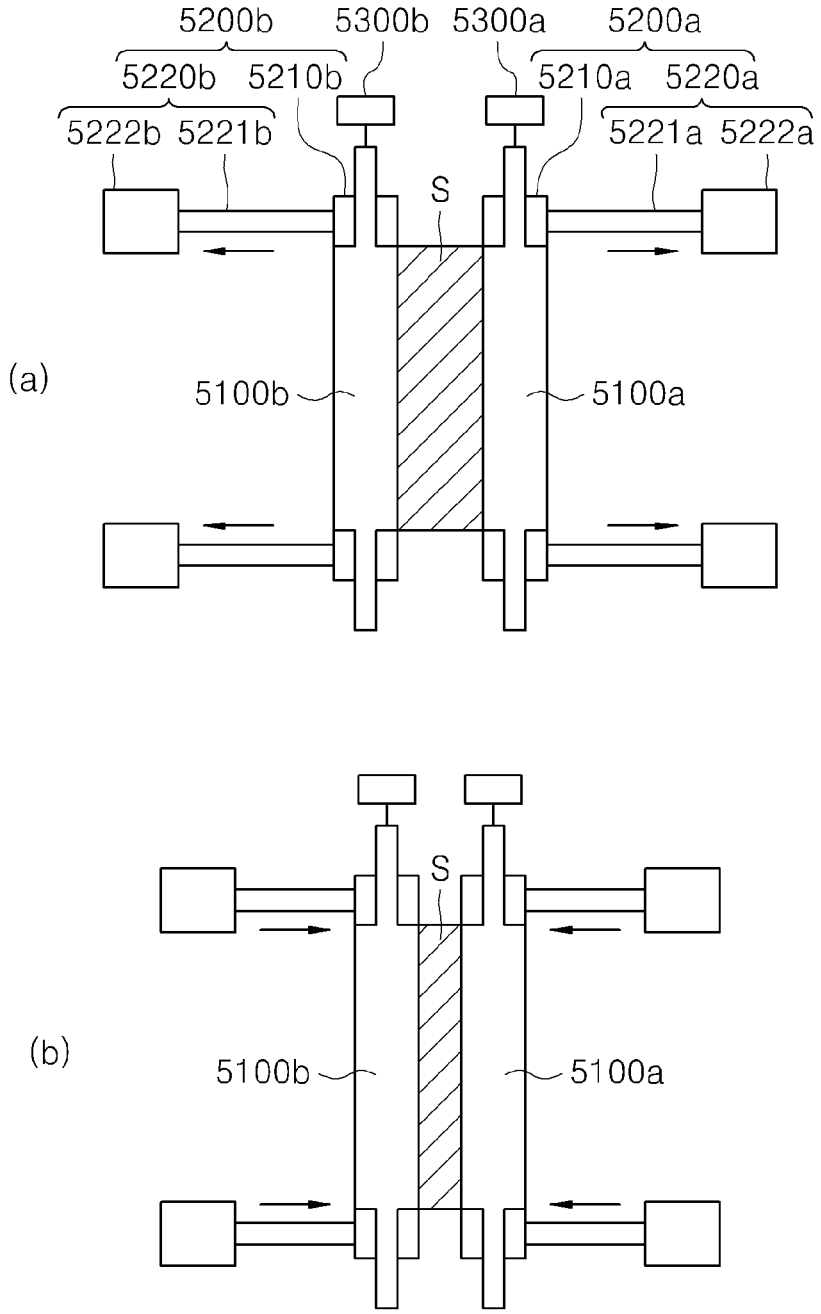
FIG. 8 is a view illustrating a state in which first and second horizontal moving parts are connected to first and second guide rolls to explain their operations in accordance with an exemplary embodiment.
Figure 9:
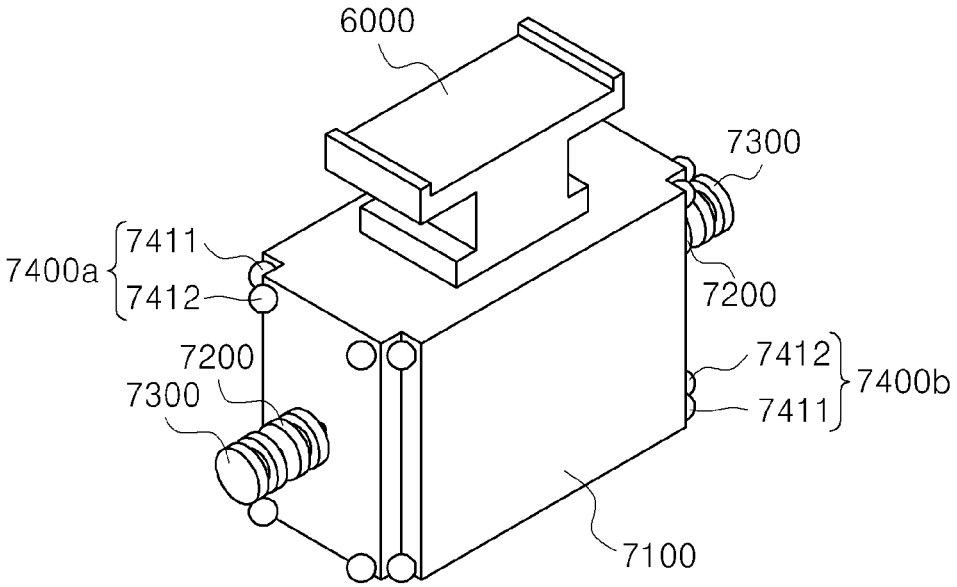
FIG. 9 is a solid view of a plate and a moving cart for moving the plate in accordance with an exemplary embodiment.
Figure 10:
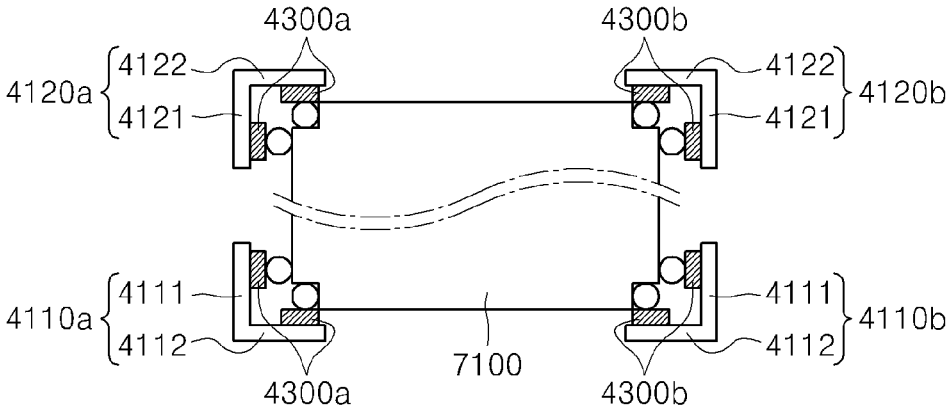
FIG. 10 is a top view illustrating a coupled relationship between the moving cart and the movement guide device in accordance with an exemplary embodiment.

FIG. 2 is a conceptual view of vertical semi-continuous casting equipment in accordance with an exemplary embodiment. FIGS. 3 and 4 are solid views of a movement guide device and a guide device in accordance with an exemplary embodiment. FIG. 5 is a schematic view illustrating a state in which a guide roll of the guide device is disposed to correspond to a spaced space between a plurality of frames in a direction in which the plurality of frames of the movement guide device are disposed. FIG. 6 is a schematic view illustrating a state in which the guide roll and a nozzle of the guide device are disposed to correspond to the spaced space between the plurality of frames in a direction in which first and second guide members of the movement guide device are disposed. FIG. 7 is a view for a blocked braking unit in accordance with an exemplary embodiment. FIG. 8 is a view illustrating a state in which first and second horizontal moving parts are connected to first and second guide rolls to explain their operations in accordance with an exemplary embodiment. FIG. 9 is a solid view of a plate and a moving cart for moving the plate in accordance with an exemplary embodiment. FIG. 10 is a top view illustrating a coupled relationship between the moving cart and the movement guide device in accordance with an exemplary embodiment. FIGS. 11 to 17 are conceptual views for explaining a vertical semi-continuous casting method using the vertical semi-continuous casting equipment in accordance with an exemplary embodiment.

Referring to FIG. 2, vertical semi-continuous casting equipment in accordance with an exemplary embodiment includes a tundish T receiving molten steel from a ladle L to temporarily store the molten steel, a mold M receiving the molten steel from the tundish T to primarily solidify the molten steel, a first stirring device 2100 disposed outside the mold M to stir the molten steel within the mold M, a foot roll 3000 disposed under the mold M to guide and assist drawing of a slab S from the mold M, a plate 6000 that is vertically movable and draws the slab S from the mold M, a movement guide device 4000 disposed under the mold M and the foot roll 3000 to extend in a direction perpendicular to the ground so that the slab S and the plate 6000 stably descend, and a guide device 5000 in which a pair of guide parts 5000*a* and 5000*b* including a plurality of guide rolls 5100*a* and 5100*b* that are disposed to be arranged in the extension direction of the movement guide device 4000 are disposed to face both sides of the movement guide device 4000 so that the slab S stably descends, the guide device 5000 injecting cooling water onto the primarily solidified slab S to secondarily solidify the slab S.

Also, the vertical casting equipment includes a moving cart 7000 disposed inside the movement guide device 4000 to support the plate 6000 and being elevatable in the extension direction of the movement guide device 4000 and a plate moving device 8000 connected too the moving cart 7000 to provide elevation driving force to the moving cart 7000. Also, the vertical casting equipment includes an oscillation generation device (not shown) disposed outside the mold M to oscillate the mold M, a separation device 9000*a* disposed on one side of the movement guide device 4000 to push the cast slab S and separate the slab S from the plate 6000, and an unloading device 9000*b* disposed on the other side of the movement guide device 4000 to face the separation device 9000*a*, the unloading device 9000*b* vertically supporting the slab S by an operation of the separation device 9000*a* and horizontally rotating to unload the slab S to the outside.

Also, the vertical casting equipment include a second stirring device 2200 disposed above one side of the movement guide device 4000 or the pair of guide parts 5000*a* and 5000*b* to stir non-solidified molten steel of the slab S drawn from the mold M or non-solidified molten steel of the slab S during the solidification and a heating device 2300 moving between the foot roll 3000 and the movement guide device 4000 to heat a top area of the cast slab S.

In the vertical casting equipment in accordance with an exemplary embodiment, the ladle L, the tundish T, the mold M, the oscillation device (not shown), and the foot roll 3000 are the same as those of the general casting equipment, and thus, their detailed descriptions will be omitted, or the above-described components will be simply described.

The vertical casting equipment including the above-described constituents in accordance with an exemplary embodiment may be called vertical semi-continuous casting equipment in that slabs are continuously cast through the plurality of ladles, and then the casting is finished.

The mold M may cool and solidify molten liquid steel supplied from the tundish T to continuously cast a slab S having a rectangular section. The mold M has a cylindrical shape that has an inner space and is opened upward and downward. That is, the mold M may have a shape corresponding to that of the slab S to be cast, for example, a rectangular section. In detail, the mold M has a pair of short sides and long sides and has a space with a rectangular section therein. Of cause, the mold M may vary in shape and size according to the shape of the slab S to be cast.

The first stirring device 2100 is disposed around the outside of the mold M to stir molten steel within the mold M. The first stirring device 2100 in accordance with an exemplary embodiment may be an electro magnetic stirrer (EMS) for generating magnetic fields in the molten steel to stir the molten steel. As the molten steel within the mold M is stirred by the first stirring device 2100, an initially solidified layer of the slab S may be uniform, and also, equiaxed grain within the slab S may increase by a uniform temperature of the molten steel within the mold M to improve internal quality of the slab S.

Of cause, the first stirring device 2100 is not limited to the above-described electro magnetic stirrer (EMS). For example, various units that are capable of stirring the molten steel within the mold M may be applied.

The plate 6000 is inserted into the mold M before the casting to close the lower opening of the mold M. After the casting starts, the plate 6000 supports the slab S that is primarily solidified to descend, thereby drawing the slab S from the mold M. A portion or the whole of the plate 6000 may be inserted into the mold M before the molten steel is introduced into the mold M. Then, when the molten steel is introduced into the mold M to start the primary solidification of the molten steel, the plate 6000 gradually descends. In the state in which the plate 6000 is inserted into the mold M, an air gap between an outer circumferential surface of the plate 6000 and an inner wall of the mold M may be sealed. Thus, when the molten steel is introduced into the mold M, leakage of the molten steel through a fine spaced space between the plate 6000 and the cooling mold M may be prevented. Also, a special groove may be defined in the plate 6000 so that the slab S is easily drawn and easily separated from the plate 6000 after the solidification of the slab S is completed.

Referring to FIGS. 2 to 6, the movement guide device 4000 is disposed to extend from a lower portion of the mold M in the vertical casting direction of the slab S so that the slab S, the plate 6000, and the moving cart 7000 stably move. The movement guide device 4000 includes a guide body 4100 extending in a vertical direction and having an inner space along which the slab S drawn from the mold M, the plate 6000, and the moving cart 7000 move in a vertical direction, i.e., an upward/downward direction, a plurality of openings 4200*a* and 4200*b* that are defined in the guide body 4100 and arranged to be spaced apart from each other in the vertical direction from both side direction of the guide body 4100 facing the pair of guide parts 5000*a* and 5000*b*, and guide members 4300*a* and 4300*b* disposed on an inner wall of the guide body 4100 in the vertical extension direction to assist the movement of the moving cart 7000.

The guide body 4100 may be a unit for allowing the slab S, the plate 6000, and the moving cart 7000 to stably move in the vertical direction. The guide body 4100 has an inner space that extends in the vertical direction and is opened upward and downward. The guide body 4100 has a section with an approximate shape corresponding to that of the slab S or the mold M. For example, when the slab S having a rectangular section is manufactured, the guide body 4100 may have a hollow with a rectangular section.

Hereinafter, a structure of the guide body 4100 will be described in more detail.

Referring to FIGS. 3 to 6, the guide body 4100 includes first and second support members 4100*a* and 4100*b* vertically extending from positions corresponding to both short sides of the mold M or the slab S and disposed to face each other and a plurality of first and second frames 4100*c* and 4100*d* disposed on positions corresponding to both long sides of the mold M or the slab S to extend in a direction crossing or perpendicular to in the extension direction of the first and second support members 4100*a* and 4100*b* and arranged to be spaced apart from each other in the extension direction of the first and second support members 4100*a* and 4100*b*. Here, a spaced space between the first frames 4100*c* disposed to be spaced apart from each other may be the first opening 4200*a* through which the first guide roll 5100*a* of the first guide part 5000*a* that will be described below in detail passes, and a spaced space between the second frames 4100*d* disposed to be spaced apart from each other may be the second opening 4200*b* through which the second guide roll 5100*b* of the second guide part 5000*b* that will be described below in detail passes. That is, the plurality of first openings 4200*a* are vertically arranged to be spaced apart from each other at positions corresponding to one long side of the mold M or the slab S, and the plurality of second openings 4200*b* are vertically arranged to be spaced apart from each other at positions corresponding to the other long side of the mold M or the slab S.

The unloading device 9000*b* is disposed outside one side of both long sides of the guide body 4100, and the separation device 9000*a* is disposed outside the other side of both long sides of the guide body 4100. In the vertical semi-continuous casting equipment in accordance with an exemplary embodiment, the separation device 9000*a* is disposed outside the first frame 4100*c* of the guide body 4100, and the unloading device 9000*b* is disposed outside the second frame 4100*d*.

Each of the first and second support members 4100*a* and 4100*b* of the movement guide device 4000 in accordance with an exemplary embodiment has a section with the same shape as "ㄷ" that is a consonant in Korean Alphabet. In more detail, the first support member 4100*a* includes a pair of first supports 4110*a* and 4120*a* that vertically extend and are disposed to be spaced apart from each other in a direction of the short side of the mold M or the slab S and a plurality of first connection members 4130*a* that connect the pair of first supports 4110*a* and 4120*a* to each other and are arranged to be spaced apart from each other in the extension direction of the first supports 4110*a* and 4120*a*.

Here, each of the pair of first supports 4110*a* and 4120*a* in accordance with an exemplary embodiment has a "ㄱ" or "ㄴ" shape that is a consonant in Korean Alphabet. In more detail, each of the pair of first supports 4110*a* and 4120*a* includes first members 4111 and 4121 extending in a direction corresponding to the short side direction of the slab S and second members 4112 and 4122 extending in a direction corresponding to the long side direction of the slab S. The first members 4111 and 4121 and the second members 4112 and 4122 are connected to each other in directions crossing or perpendicular to each other. Also, the two first members 4111 and 4121 constituting each of the pair of first supports 4110*a* and 4120*a* are disposed to be spaced apart from each other.

The second support member 4100*b* may have the same shape and constituent as the above-described first support member 4100*a*. The second support member 4100*b* includes a pair of second supports 4110*b* and 4120*b* that vertically extend and are disposed to face the pair of first supports 4110*a* and 4120*a* of the first support member 4100*a* and a plurality of second connection members 4130*b* that connect the pair of second supports 4110*b* and 4120*b* to each other and are arranged to be spaced apart from each other in the extension direction of the second supports 4110*b* and 4120*b*.

Here, each of the pair of second supports 4110*b* and 4120*b* in accordance with an exemplary embodiment has a " ㄱ " or " ㄴ " shape that is a consonant in Korean Alphabet. In more detail, each of the pair of second supports 4110*b* and 4120*b* includes first members 4111 and 4121 extending in a direction corresponding to the short side direction of the slab S and second members 4112 and 4122 extending in a direction corresponding to the long side direction of the slab S. The first members 4111 and 4121 and the second members 4112 and 4122 are connected to each other in directions crossing or perpendicular to each other. Also, the two first members 4111 and 4121 constituting each of the pair of first supports 4110*a* and 4120*a* are disposed to be spaced apart from each other.

When the casting of the slab S is finished, the separation device 9000*a* disposed outside one side of the guide body of the movement guide device 4000 pushes the slab S in an outer direction of the other side of the guide body 4100 to seat the slab S on the unloading device 9000*b*. That is, the cast slab S is unloaded in the direction of the other side of the guide body 4100. Thus, the plurality of first frames 4100*c* disposed in the direction of the other side of the guide body 4100 on which the unloading device 9000*b* is disposed are not arranged up to lower portions of the first and second support members 4100*a* and 4100*b*, but arranged up to an upper portion of the unloading device 9000*b* that vertically stands up. Thus, a region defined under the lowermost first frame 4100*d* of the plurality of first frames 4100*c* in the guide body 4100 may be defined in a space in which the slab S is separated from the movement guide device 4000.

The guide members 4300*a* and 4300*b* vertically extend inward from the first and second support members 4100*a* and 4100*b* to guide the vertical movement of the moving cart 7000, respectively. That is, the first guide member 4300*a* is disposed inside the first support member 4100*a*, and the second guide member 4300*b* is disposed inside the second support member 4100*b*. Each of the first and second guide members 4300*a* and 4300*b* in accordance with an exemplary embodiment may have a rail shape, but is not limited thereto. For example, various units that are capable of guiding the movement of the moving cart 700 may be applied.

In an exemplary embodiment, the first guide member 4300*a* is disposed on each of the pair of first supports 4110*a* and 4120*a* constituting the first support member 4100*a*, and the second guide member 4300*b* is disposed each of the pair of second supports 4110*b* and 4120*b* constituting the second support member 4100*b*. In more detail, the first guide member 4300*a* is disposed on an inner surface of each of the first members 4111 and 4121 and the second members 4112 and 4122 respectively constituting the pair of first supports 4110*a* and 4120*a*, and the second guide member 4300*b* is disposed on an inner surface of each of the first members 4111 and 4121 and the second members 4112 and 4122 respectively constituting the pair of second supports 4110*b* and 4120*b*.

The guide device 5000 may operate to support an outer surface of the slab S that is drawn from the mold M by the plate 6000, and then to assist the descending of the slab S and inject the cooling water onto the descending slab S, thereby secondarily cooling the slab S. Referring to FIGS. 2 to 6, the guide device 5000 in accordance with an exemplary embodiment includes a first guide part 5000*a* disposed on one side of the movement guide device 4000 and a second guide part 5000*b* disposed on the other side of the movement guide device 4000 to face the first guide part 5000*a*. Each of the first and second guide parts 5000*a* and 5000*b* is disposed to face the long side of the descending slab S or each of the first and second frames 4100*c* and 4100*d* of the movement guide device 4000. That is, the first guide part 5000*a* is disposed in a direction that faces one long side of the slab S or the first frame 4100*c* of the movement guide device 4000, and the second guide part 5000*b* is disposed in a direction that faces the other long side of the slab S or the second frame 4100*d*.

The first guide part includes a plurality of first guide rolls 5100*a* vertically arranged to be spaced apart from each other at positions facing the first opening 4200*a* of the movement guide device 4000 and support one long side of the descending slab S, a first roll driving unit 5200*a* connected to each of the plurality of first guide rolls 5100*a* to allow the first guide rolls 5100*a* to easily rotate and move horizontally or forward/backward, a first braking unit 5300*a* connected to each of the plurality of first guide rolls 5100*a* to apply braking force to the first guide rolls 5100*a*, thereby to adjust rotation force of the first guide rolls 5100*a*, a plurality of nozzles 5400*a* vertically spaced apart from each other between the plurality of first guide rolls 5100*a* to inject the cooling water onto the slab S descending into the movement guide device 4000, and a first body 5500*a* disposed to support and fix the plurality of first guide rolls 5100*a*, the plurality of first roll driving units 5200*a*, the plurality of first nozzles 5400*a*.

The second guide part includes a plurality of second guide rolls 5100*b* vertically arranged to be spaced apart from each other at positions facing the second opening 4200*b* of the movement guide device 4000 and support the other long side of the descending slab S, a second roll driving unit 5200*b* connected to each of the plurality of second guide rolls 5100*b* to allow the second guide rolls 5100*b* to easily rotate and move horizontally or forward/backward, a second braking unit 5300*b* connected to each of the plurality of second guide rolls 5100*b* to apply braking force to the second guide rolls 5100*b*, thereby to adjust rotation force of the second guide rolls 5100*b*, a plurality of nozzles 5400*b* vertically spaced apart from each other between the plurality of second guide rolls 5100*b* to inject the cooling water onto the slab S descending into the movement guide device 4000, and a second body 5500*b* disposed to support and fix the plurality of second guide rolls 5100*b*, the plurality of second roll driving units 5200*b*, the plurality of second nozzles 5400*b*.

The first guide roll 5100*a* extends in a direction corresponding to one long side of the mold M or the slab S to rotate by the movement of the slab S. Also, the plurality of first guide rolls 5100*a* are disposed to correspond to the plurality of first openings 4200*a* that are vertically arranged, respectively. That is, each of the plurality of first guide rolls 5100*a* is disposed to correspond to the spaced space (the first opening 4200*a*) between the plurality of first frames 4100*c* that are vertically arranged. The first guide roll 5100*a* move horizontally or forward/backward to pass through the first opening 4200*a* by the first roll driving unit 5200*a*.

The second guide roll 5100*b* extends in a direction corresponding to the other long side of the mold M or the slab S to rotate. Also, the plurality of second guide rolls 5100*b* are disposed to correspond to the plurality of second openings 4200*b* that are vertically arranged, respectively. That is, each of the plurality of second guide rolls 5100*b* is disposed to correspond to the spaced space (the second opening 4200*b*) between the plurality of second frames 4100*d* that are vertically arranged. The second guide roll 5100*b* move horizontally or forward/backward to pass through the second opening 4200*b* by the second roll driving unit 5200*b*.

The first roll driving unit 5200*a*, the second roll driving unit 5200*b*, the first braking unit 5300*a*, and the second braking unit 5300*b* have the same constituent and structure, Thus, the first driving units 5200*a* and the first braking unit 5300*a* will be described, and description with respect to the second roll driving unit 5200*b* and the second braking unit 5300*b* will be omitted or simplified.

The first roll driving unit 5200*a* includes a pair of first support blocks 5210*a* connected to one end and the other end of the first guide roll 5100*a* and a first horizontal moving part 5220*a* connected to each of the pair of first support blocks 5210*a* to provide driving force for the horizontal or forward/backward movement.

The pair of first support blocks 5210*a* may be connected to one end and the other end of the first guide roll 5100*a*, and a unit such as a bearing for smooth rotation of the first guide roll 5100*a* may be disposed in each of the pair of first support blocks 5210*a*. That is, the bearing is disposed in each of the pair of first support blocks 5210*a*, and one end and the other end of the first guide roll 5100*a* are connected to the bearing disposed in the first support block 5210. The first support block 5210*a* covers the bearing and the one end and the other end of the first guide roll 5100*a* connected to the bearing.

The first and second horizontal moving parts 5220*a* and 5220*b* may horizontally move the first and second guide rolls 5100*a* and 5100*b* according to a thickness of the slab S to be cast to adjust a distance between the first and second guide rolls 5100*a* and 5100*b*.

The pair of first horizontal moving part 5220*a* may be respectivley connected to the pair of first support blocks 5210*a* to provide horizontal driving force, i.e., forward/backward moving force to the pair of first support blocks 5210*a*, and the pair of second horizontal moving part 5220*b* may be respectively connected to the pair of second support blocks 5210*a* to provide horizontal moving force, i.e., forward/backward moving force to the pair of second support blocks 5210*b*.

As illustrated in FIG. 8, each of the first and second horizontal moving parts 5220*a* and 5220*b* includes driving shafts 5221*a* and 5221*b* connected to the support blocks 5210*a* and 5210*b* to move forward and backward and driving sources 5222*a* and 5222*b* for moving the driving shafts 5221*a* and 5221*b* forward and backward.

Each of the first and second horizontal moving parts 5220*a* and 5220*b* in accordance with an exemplary embodiment may be a hydraulic cylinder, but is not limited thereto. For example, various units that are capable of moving the first and second guide rolls 5100*a* and 5100*b* forward and backward may be applied.

The first and second guide rolls 5100*a* and 5100*b* support one surface and the other surface of the descending slab S that is drawn from the mold M to rotate by the descending force of the slab S. Also, the mold M may be oscillated by using a separate oscillation device to prevent the molten stall from being stuck on the inner wall of the mold M during the casting. However, when the mold M is oscillated, the slab S drawn from the mold M may be vertically oscillated or shaken. Thus, since the first and second guide rolls 5100*a* and 5100*b* support the slab S, the slab S may be slipped. The casting speed of the slab S may not be controlled to a designated or set speed due to the shaking of the slab S. Thus, the slab S may be cast at an unstable or inaccurate casting speed. This may deteriorate surface quality of the slab S and cause casting accidents.

Thus, the first and second braking units 5300*a* and 5300*b* may be respectivley provided on the first and second guide rolls 5100*a* and 5100*b* to control the rotation force of the first and second guide rolls 5100*a* and 5100*b* that rotate by the descending force of the slab S, thereby preventing the slab S from being shaken.

Each of the first and second braking units 5300*a* and 5300*b* in accordance with an exemplary embodiment may be provided as a hydraulic disc brake to adjust a hydraulic pressure, thereby controlling the braking force. The hydraulic pressure and the braking force of each of the first and second braking units 5300*a* and 5300*b* may be adequately adjusted according to the casting speed and the intensity of the oscillation.

Thus, when the slab S is cast, the first and second braking units 5300*a* and 5300*b* may operate to add predetermined braking force to the first and second guide rolls 5100*a* and 5100*b*, thereby controlling the rotation force of each of the first and second guide rolls 5100*a* and 5100*b*. Here, the first and second guide rolls 5100*a* and 5100*b* may not rotate by being synchronized with the descending speed of the plate 6000. Thus, when the shaking of the slab S occurs, the first and second guide rolls 5100*a* and 5100*b* may apply force to the slab S to interrupt the vertical movement of the slab S, thereby preventing the slab S from being shaken.

As illustrated in FIG. 7, each of the first and second braking units 5300*a* and 5300*b* includes a housing 5310 having an inner space, a disc 5320 connected to the guide rolls 5100*a* and 5100*b* to rotate together with the guide rolls 5100*a* and 5100*b*, first and second pads 5330*a* and 5330*b* disposed to be respectivley spaced apart from one surface and the other surface of the disc 5320, first and second pistons 5400*a* and 5400*b* disposed in the housing 5310 and respectively connected to rear portions of the first and second pads 5330*a* and 5330*b* to move forward and backward, and a supply tube 5500 connected to the housing 5310 to supply hydraulic oil into the housing 5310. Here, a front side of each of the first and second pads 5330*a* and 5330*b* and a front side of each of the first and second pistons 5400*a* and 5400*b* may be a direction in which the disc 5320 is disposed, and a rear side may be an opposite direction. The supply tube 5500 is connected to a main body to supply oil to a rear side of each of the first and second pistons 5400*a* and 5400*b*.

In accordance with the first and second braking units 5300*a* and 5300*b*, when the oil is supplied from the supply tube 5500 to the main body, the first and second pistons 5400*a* and 5400*b* may advance to a disc direction, and thus, the first and second pads 5330*a* and 5330*b* may contact the disc. Here, when the first and second pads 5330*a* and 5330*b* respectively contact one surface and the other surface of the rotating disc, braking force may be applied to the disc by friction force. Thus, the braking force may be applied to the guide rolls 5100*a* and 5100*b* connected to the disc.

Although each of the first and second braking units 5300*a* and 5300*b* in accordance with an exemplary embodiment is provided as the hydraulic disc brake, the present disclosure is not limited thereto. For example, various units that are capable of applying the braking force to the rotation of the first and second guide rolls 5100*a* and 5100*b* to control the rotation may be applied.

The plate moving device 8000 may be a unit for allowing the plate 6000 to ascend or descend. The plate moving device 8000 in accordance with an exemplary embodiment may be a driving unit using a wire or a wire rope. The plate moving device 8000 in accordance with an exemplary embodiment includes a first driving unit 8000*a* disposed in an upper portion of the movement guide device 4000, a second driving unit 8000*b* disposed in a lower portion of the movement guide device 4000, a first wire W1 wound to connect a first sheave 7200 disposed on the moving cart 7000 to the first driving unit 8000*a*, and a second wire W2 wound to connect a second sheave 7300 to the second driving unit 8000*b*.

The first driving unit 8000*a* includes a pair of rotatable first winches 8100*a* disposed to face each other outside the upper portion of the movement guide device and around which the first wire W1 is wound, a rotatable first drum 8300*a* around which the first wire W1 is wound, and a first motor 8400*a* connected to the first drum 8300*a* to provide rotation force. Also, the first driving unit 8000*a* includes a rotatable first direction adjusting part 8200*a* disposed between the first winches 8100*a* and the first drum 8300*a* and around which the first wire W1 is wound to switch a direction. Here, the pair of first winches 8100*a* may be disposed to face the first and second support members 4100*a* and 4100*b* outside the first and second support members 4100*a* and 4100*b* of the guide body 4100.

The second driving unit 8000*b* includes a pair of rotatable second winches 8100*b* disposed to face each other outside the upper portion of the movement guide device and around which the first wire W1 is wound, a rotatable second drum 8300*b* around which the second wire W2 is wound, and a second motor 8400*b* connected to the second drum 8300*b* to provide rotation force. Also, the second driving unit 8000*b* includes a rotatable first direction adjusting part 8200*a* disposed between the second winches 8100*b* and the second drum 8300*b* and around which the second wire W2 is wound to switch a direction. Here, the pair of second winches 8100*b* may be disposed to face the first and second support members 4100*a* and 4100*b* outside the first and second support members 4100*a* and 4100*b* of the guide body 4100.

The first driving unit 8000*a* may pull or unwind the first wire W1 to allow the moving cart 7000 to ascend or descend. The second driving unit 8000*b* may allow the second wire W2 to have tension according to the ascending or descending of the moving cart, thereby allowing the plate 6000 and the moving cart 7000 to stably move.

In an exemplary embodiment, a unit in which the winch is provided to each of the first and second driving units 8000*a* and 8000*b* to wind or unwind the wires W1 and W2, thereby moving the plate 6000 is described as an example. However, the first and second driving units 8000*a* and 8000*b* are not limited thereto. For example, various units that are capable of moving the plate 6000, i.e., a hydraulic cylinder may be applied.

Although the guide device 5000 includes the two guide parts 5000*a* and 500*b*, the present disclosure is not limited thereto. For example, an additional guide part may be further provided according to various casting conditions and equipment constituents.

The moving cart 7000 supports the plate 6000 and is disposed inside the movement guide device 4000 to ascend or descend along an extension direction of the movement guide device 4000 by the plate moving device 8000 that will be described below in detail.

As illustrated in FIGS. 2, 9, and 10, the moving cart 7000 includes a cart body 7100 supporting the plate 6000, a pair of rotatable first sheaves 7200 spaced apart from both side surfaces of the cart body 7100 in a direction facing the first and second support members 4100*a* and 4100*b* of the movement guide device 4000 and around which the first wire W1 is wound, a pair of rotatable second sheaves 7300 spaced apart from both outsides of the pair of first sheaves 7200 and around which the second wire W2 is wound, and gliding parts 7400*a* and 7400*b* respectively disposed on both side surfaces of an outer surface of the moving cart 7000, which face the first and second support members 4100*a* and 4100*b* and glided along the first and second guide members 4300*a* and 4300*b*. Here, the first and second sheaves 7200 and 7300 are fixedly disposed to be connected to the movement cart body 7100 to move together with the ascending/descending cart body.

The cart body 7100 may have a shape corresponding to that of the section of the movement guide device 4000, for example, a rectangular shape. The cart body 7100 may be elevated along the guide members 4300*a* and 4300*b* disposed inside the guide body 4100 and the movement guide device 4000. For this, first and second gliding parts 7400*a* and 7400*b* that are capable of being glided along the first and second guide members 4300*a* and 4300*b* are disposed on outer surfaces of the moving cart 7000, which faces the first and second support members 4100*a* and 4100*b*, respectivley.

That is, the first and second gliding parts 7400*a* and 7400*b* are disposed at positions corresponding to the first and second guide members 4300*a* and 4300*b* on each of one surface and the other surface of the moving cart 700 facing the first and second support members 4100*a* and 4100*b* of the guide member 4100 of the movement guide device 4000. For example, if the moving cart has the rectangular shape, as illustrated in FIG. 9, the gliding parts may be disposed at four corners on each of the one side and the other side of the moving cart 700. Also, the first and second gliding parts 7400*a* and 7400*b* disposed on the moving cart 7000 may be disposed to be glided along the first and second guide members 4300*a* and 4300*b*. That is, the plurality of first gliding parts 7400*a* may be disposed on the one surface of the moving cart 7000 and glided along the first guide member 4300*a* disposed on the first support member 4100*a*. Also, the plurality of second gliding part may be disposed on the other surface of the moving cart 7000 and glided along the second guide member 4300*b* disposed on the second support member 4100*b*. That is to say, the first and second gliding parts 7400*a* and 7400*b* may be disposed on the four corners on each of the one surface and the other surface of the moving cart 7000.

Each of the first and second gliding parts 7400 and 7400*b* includes a first gliding member 7411 and a second gliding member 7412. The first gliding member 7411 may be disposed closer to the corner than the second gliding member 7412. Thus, the first gliding member 7411 may be glided along the first and second guide members 4300*a* and 4300*b* disposed on the second members 4112 and 4122 respectively constituting the first and second support members 4100*a* and 4100*b*, and the second gliding member 7412 may be glided along the first and second guide members 4300*a* and 4300*b* disposed on the first members 4111 and 4121 respectively constituting the first and second support members 4100*a* and 4100*b*.

A ball-shaped unit or various units that are capable of being glided along the guide member may be applied as each of the first and second gliding members 7411 and 7412 in accordance with an exemplary embodiment.

The heating device 2300 may heat the top portion of the slab S before the slab S is unloaded to prevent the slab S from being solidified first from the top portion, thereby reducing the pipe defect on the top portion of the slab S. The heating device 2300 includes a heating body 2310 having a hollow with an opening through which the slab S passes and a heater 2320 disposed in the heating body 2310. The heating device 2300 in accordance with an exemplary embodiment may be an electro magnetic heater (EMH), and the heater may be an induction heating coil.

The unloading device 9000*b* may receive the slab S that is placed in a vertical state from the plate 6000 to rotate to a horizontal state. The unloading device 9000*b* includes a first seating part 9100 supporting and seating a lower portion of the slab S that is in the vertical state and separated from the plate 6000, a second seating part 9200 extending in a direction crossing the first seating part 9100 and connected to the first seating part 9100 to face a side surface of the slab S, a plurality of rotatable unloading rollers 9300 arranged in the extension direction of the second seating part 9200, and a rotation driving part 9400 disposed to connect the first and second seating parts 9100 and 9200 to each other to rotate or tilt the unloading device 9000*b*.

The separation device 9000*a* is disposed outside the movement guide device 4000 to face the unloading device 9000*b* and push the cast slab S toward the unloading device 9000*b*, thereby separating the slab S from the plate 6000. The separation device 9000*a* may be provided in plurality and spaced apart from each other in a vertical direction or upward/downward direction with respect to the ground. The separation device 9000*a* in accordance with an exemplary embodiment may be provided as the hydraulic cylinder, but the present disclosure is not limited thereto. For example, various unit that are capable of pushing the slab S to the unloading device 9000*b* to separate the slab S from the plate 6000 may be applied.

Hereinafter, a vertical semi-continuous casting method using the semi-continuous casting equipment in accordance with an exemplary embodiment will be described with reference to FIGS. 11 to 17.

Figure 11:
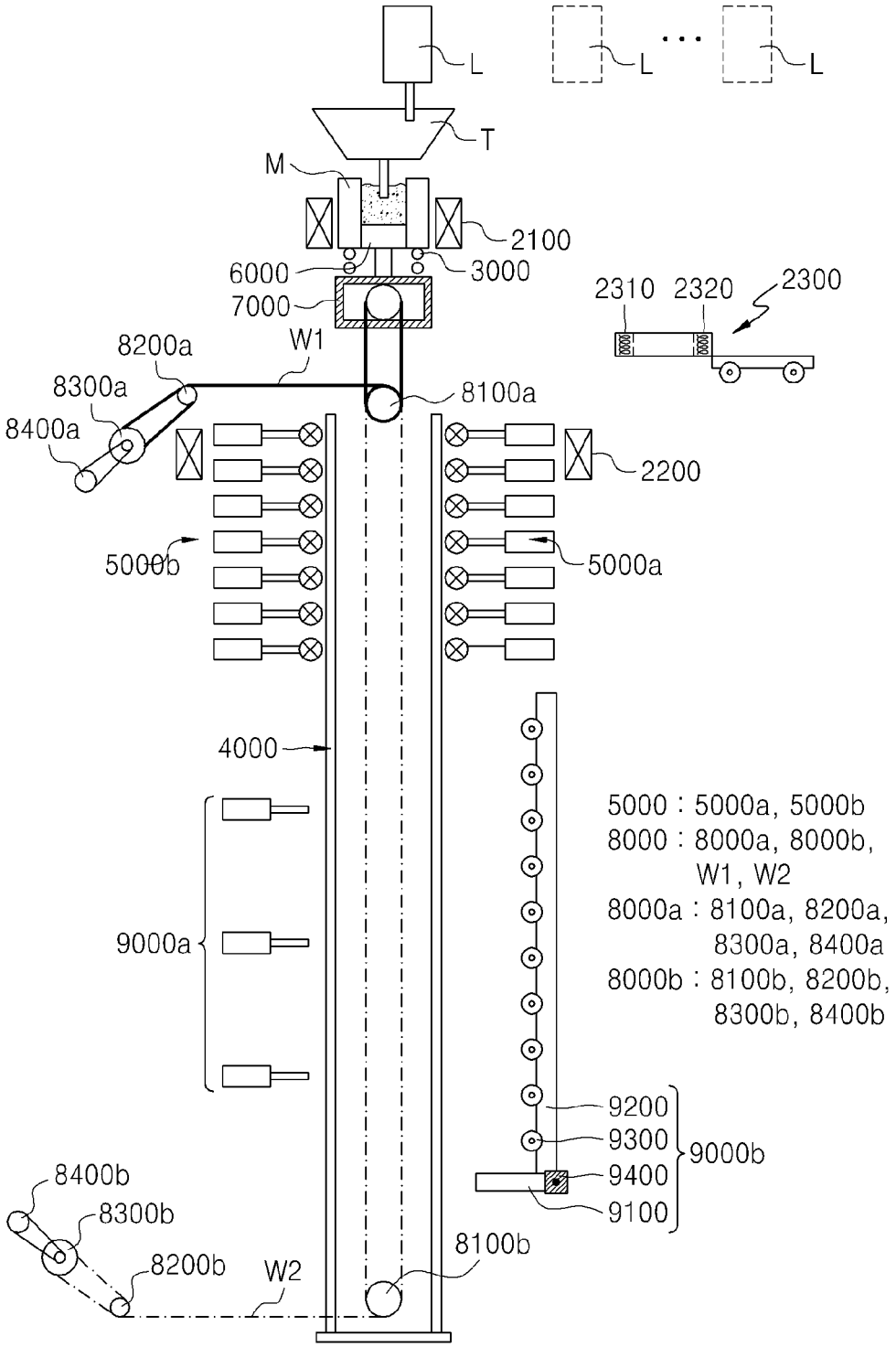
FIGS. 11 to 17 are conceptual views for explaining a vertical semi-continuous casting method using the vertical semi-continuous casting equipment in accordance with an exemplary embodiment.

First, the moving cart 7000 ascends through the plate moving device 8000. Then, as illustrated in FIG. 11, the plate 6000 is inserted into a lower side of the mold M to close the lower side of the mold M. That is, when the first winch 8100*a* rotates to pull the first wire W1, the moving cart 7000 and the plate 6000 ascend. Here, the plate 6000 moves to close the lower opening of the mold M. Also, the first and second horizontal moving parts 5220*a* and 5220*b* of the guide device 5000 operate to allow each of the first and second guide rolls 5100*a* and 5100*b* to move forward or backward according to a thickness of the slab S to be cast, thereby adjusting a spaced distance between the first and second guide rolls 5100*a* and 5100*b*.

Also, the ladle L in which the molten steel is accommodated moves above the tundish T to tap the molten steel of the ladle L to the tundish.

When the molten steel of the tundish T is supplied into the mold M through the nozzle, the molten steel is primarily solidified in the mold M. Here, the solidification of the molten steel starts on the plate 6000. While the molten steel is supplied into the mold M, the first stirring device 2100 disposed outside the mold M operates to stir the molten steel within the mold M. Also, a separate oscillation device oscillates the mold M to prevent the molten steel from being stuck on the inner wall of the mold M.

Figure 12:
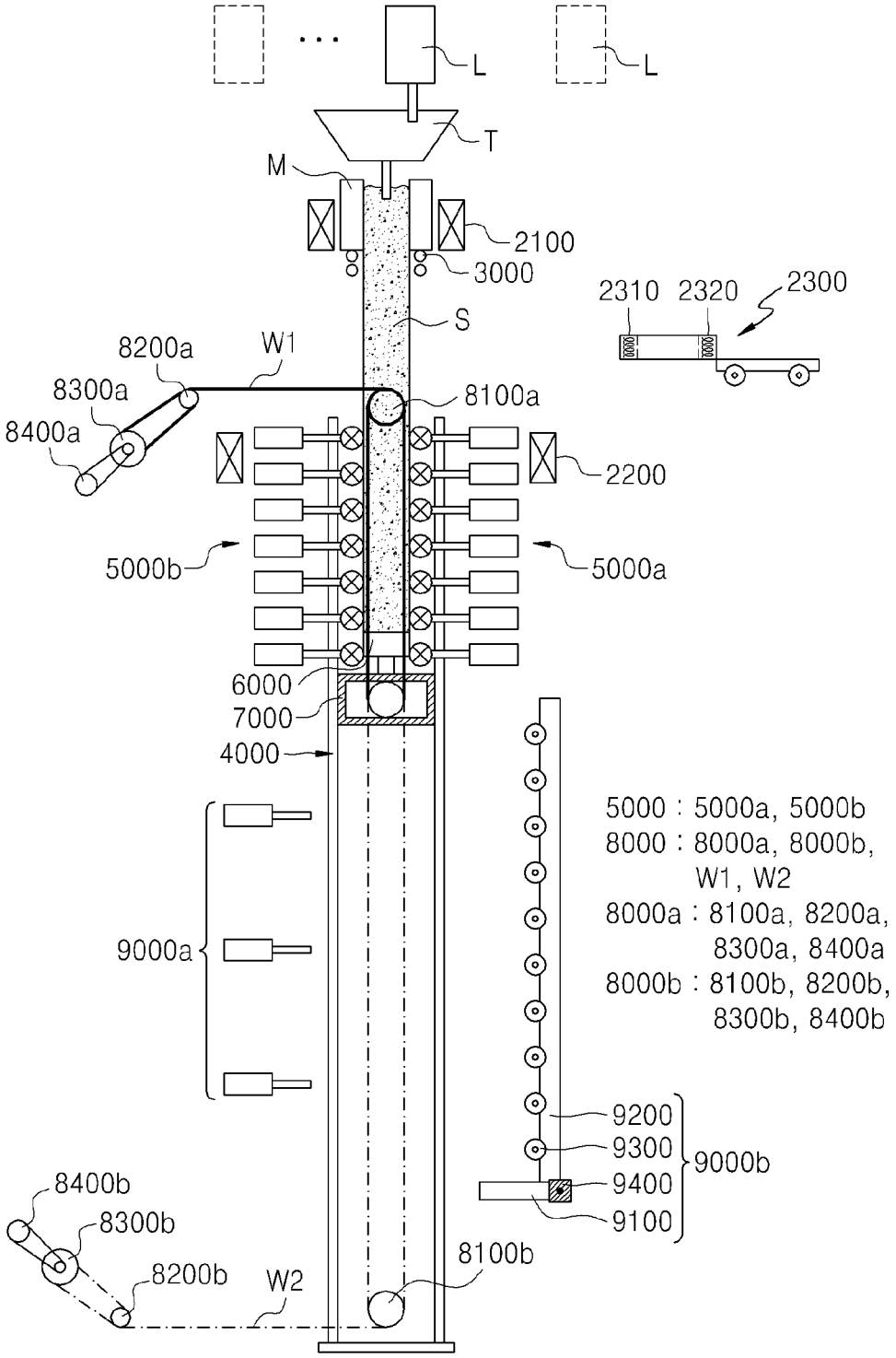

Also, when the moving cart 7000 and the plate 6000 descend through the plate moving device 8000, as illustrated in FIG. 12, the primarily solidified slab S is drawn from the mold M. When the molten steel is continuously injected into the mold M, the plate 6000 descends to cast a slab S having a predetermined length (see FIG. 13). In the casting through one charging in accordance with an exemplary embodiment, the molten steel may be continuously supplied through the plurality of ladles L to perform the continuous casting. In other words, although the slab S is cast as much as an amount of molten steel supplied from one ladle L in accordance with the related art, the slab S may be continuously cast as much as an amount of molten steel continuously supplied from at least two ladles L in accordance with an exemplary embodiment.

Figure 13:
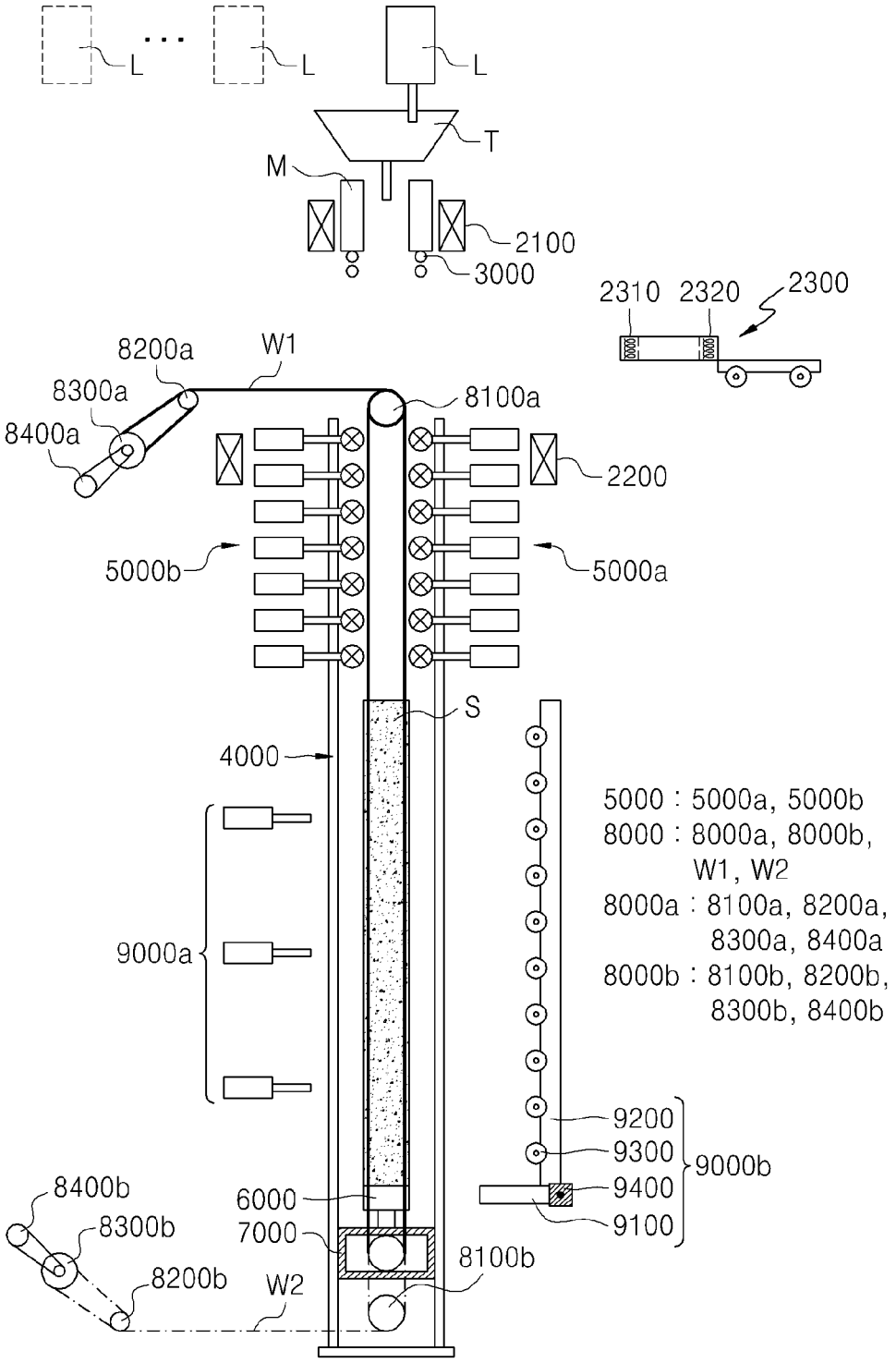
Figure 14:
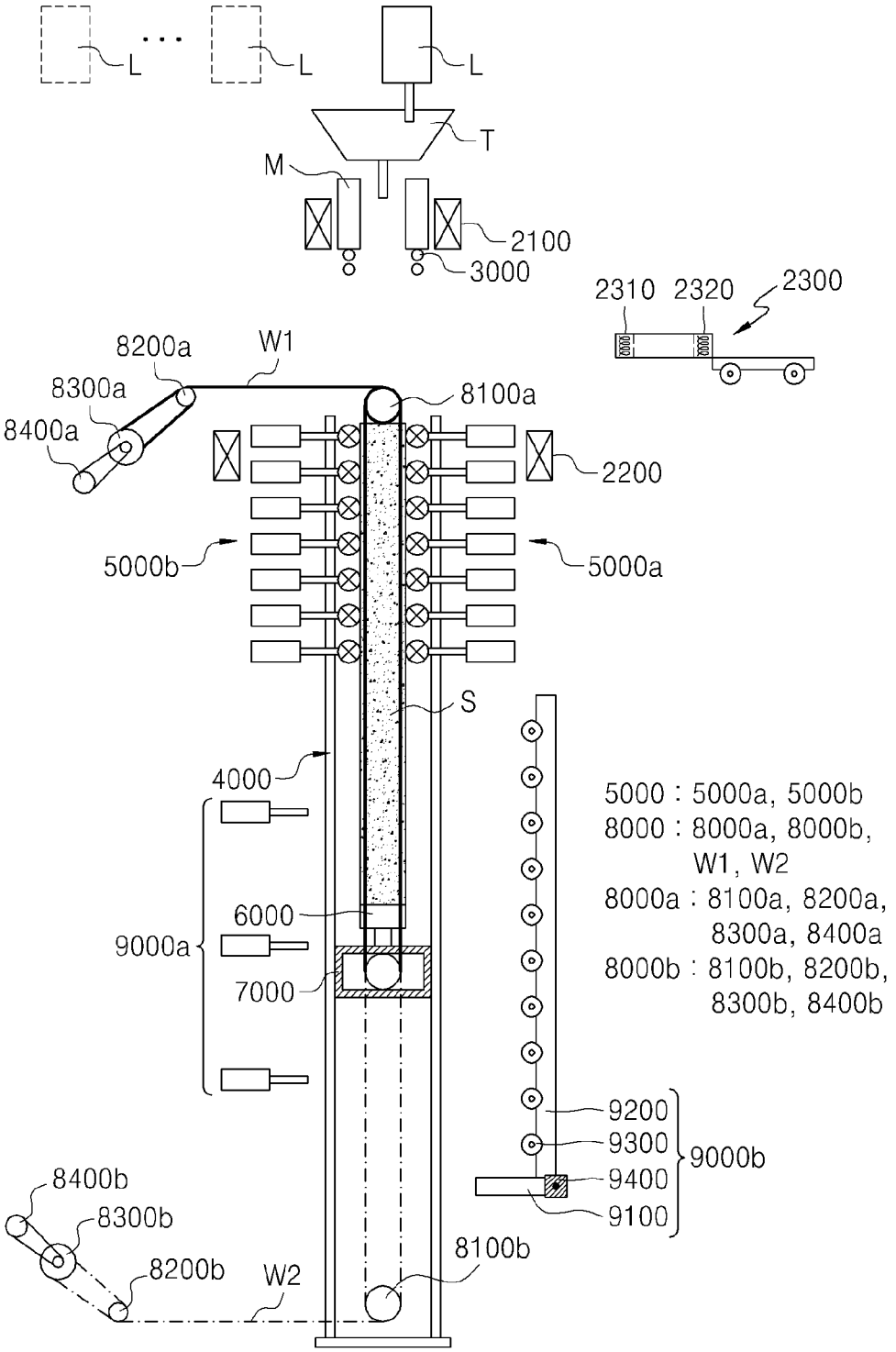

The slab S cast and drawn from the mold M descends to pass through the inside of the movement guide device 4000 as illustrated in FIGS. 12 to 14. Here, the slab S descends in the state in which the side surface of the slab S is supported by the first and second guide rolls 5100*a* and 5100*b*, and the first and second guide rolls 5100*a* and 5100*b* rotate by the descending force of the slab S. Then, the slab S is secondarily cooled by the cooling water injected from the plurality of first and second nozzles 5400*a* and 5400*b*. Also, the second stirring device 2200 disposed outside each of the first and second guide parts 5000*a* and 5000*b* operates to stir the non-solidified molten steel on the top portion of the slab S, thereby minimizing the pipe defect.

When the mold M is oscillated, the slab S drawn from the mold M is vertically shaken. In accordance with an exemplary embodiment, to prevent the slab S from being shaken, the braking units 5300*a* and 5300*b* are respectively disposed on the first and second guide rolls 5100*a* and 5100*b* to prevent the slab S from being shaken. That is, when the slab S is cast, the first and second braking units 5300*a* and 5300*b* may operate to add predetermined braking force to the first and second guide rolls 5100*a* and 5100*b*, thereby controlling the rotation force of each of the first and second guide rolls 5100*a* and 5100*b*. Thus, when the shaking of the slab S occurs, the first and second guide rolls 5100*a* and 5100*b* may apply force to the slab S to interrupt the vertical movement of the slab S, thereby preventing the slab S from being shaken. Also, the slab S, the plate 6000, and the moving cart 7000 descend to pass through the inside of the movement guide device 4000. Here, since the second winch 8100*b* tensionally supports the second wire W2 at the lower side of the plate 6000, the stable descending may be enabled.

Figure 15:
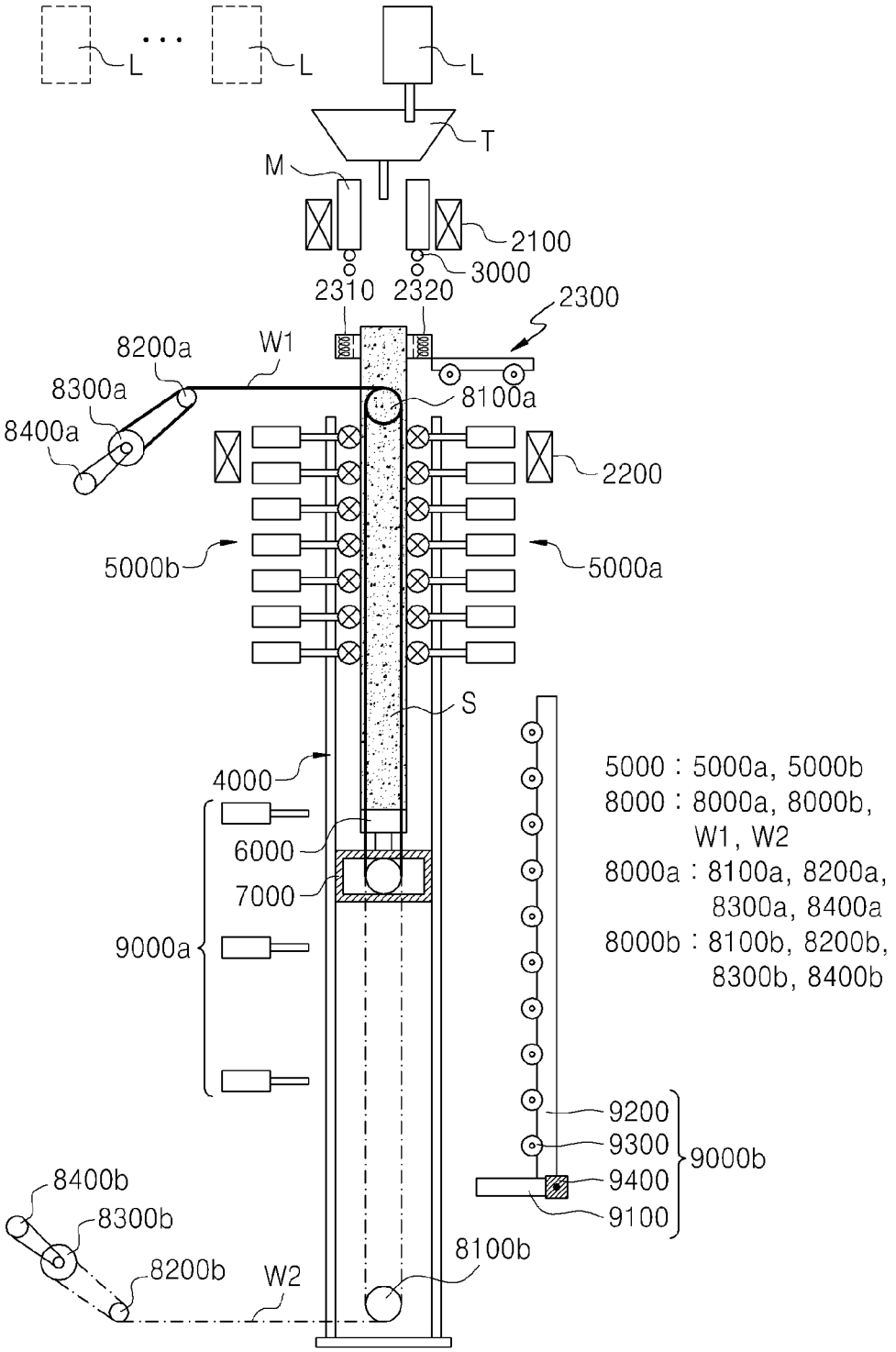

When the slab S having a desired length is cast by the continuous casting in which the molten steel is supplied through the plurality of ladles L, as illustrated in FIG. 15, the heating device is disposed above the movement guide device 4000. Also, the plate 6000 and the moving cart 7000 ascend by a predetermined distance to allow the top portion of the slab S to be inserted into the opening of the heating device. Thereafter, when the heating device 2300 operates, the top portion of the slab S may be heated to minimize the pipe defect at the top portion of the slab S.

Figure 16:
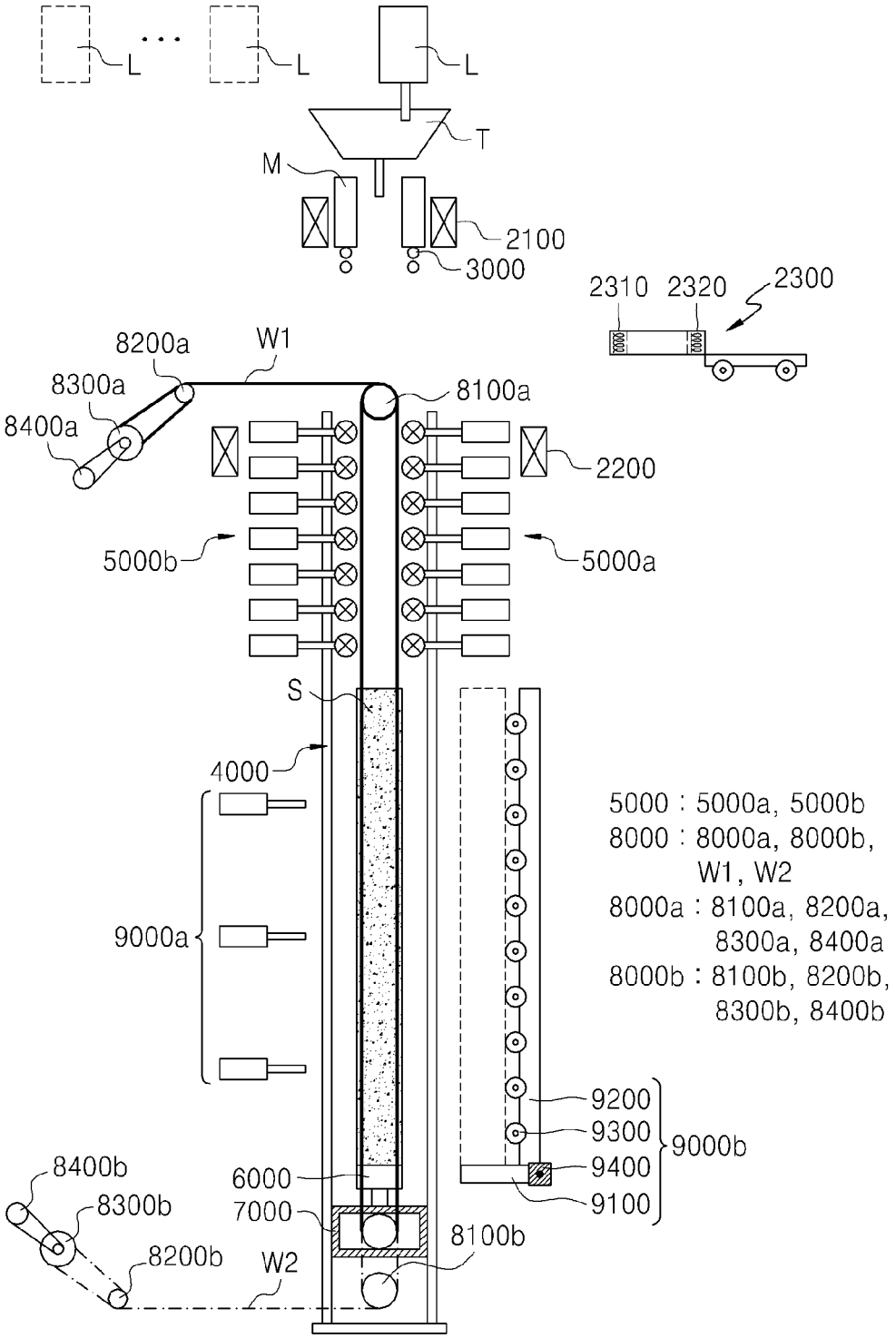
Figure 17:
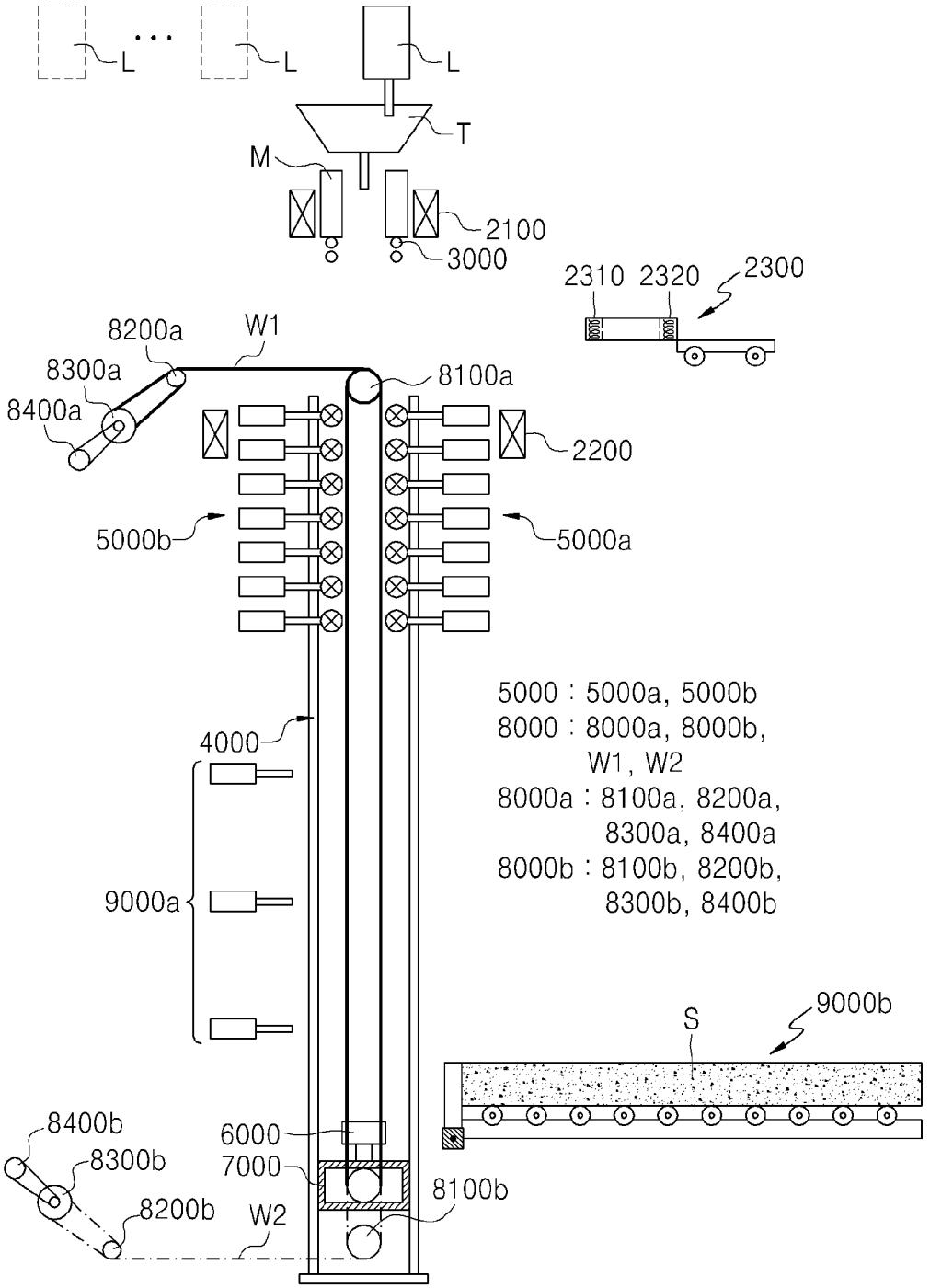

When the heating of the top portion of the slab S is finished, as illustrated in FIG. 16, the slab S descends up to an unloading position. That is, the top portion of the slab S may be disposed under the lowermost first frame 4100*c* of the plurality of first frames 4100*c*. Thereafter, when the separation device 9000*a* operates to push the slab S, the slab S moves to the unloading device 9000*b* that vertically stands up. Also, as illustrated in FIG. 17, the unloading device 9000*b* may be tilt to allow the slab S to be placed in the horizontal direction, thereby unloading the slab S.

In accordance with the embodiment, the molten steel may be continuously supplied through the plurality of ladles L to continuously perform the vertical casting of the slab, thereby casting a thick slab S having a thickness of about 400 mm to about 1,000 mm. That is, in case of the casting of a very large-section slab having the very thick thickness, only the casting through one charging is performed as much as an amount of molten steel that supplied from one ladle L by using the vertical semi-continuous casting equipment due to the solidification characteristics and quality limitations, and then, the casting is finished. However, the guide device 5000 and the movement guide device 4000 may be disposed under the mold M, and the braking units 5300*a* and 5300*b* may be connected to the guide rolls 5100*a* and 5100*b* to control the rotation force of the guide rolls 5100*a* and 5100*b*. Thus, the slab having the length longer than that of the slab in accordance with the related art may stably descend, the shaking of the slab S may be prevented, and the casting speed may be stabilized. Therefore, since the vertical semi-continuous casting may be performed by using the molten steel supplied from the plurality of ladles L, but not one ladle L, to improve the productivity and recovery of the slab by more than two times.

In accordance with the embodiments, the molten steel may be continuously supplied through the plurality of ladles to continuously perform the vertical casting of the slab. That is, in the related art, only the casting through the one charging is performed by using an amount of molten steel supplied from one ladle, and then, the casting is finished. Here, if the casting length of the slab having a relatively thick thickness is long, the slab may be unstable in movement to cause the casting accident. Also, since it is difficult to perform the cast at a uniform casting speed due to the unstable movement of the slab, the slab may be deteriorated in quality. However, the guide device and the movement guide device may be disposed under the mold, and the braking unit may be connected to the guide roll to control the rotation force of the guide roll. Thus, the slab having the length longer than that of the slab in accordance with the related art may stably descend, the shaking of the slab may be prevented, and the casting speed may be stabilized. Therefore, since the vertical semi-continuous casting may be performed by using the molten steel supplied from the plurality of ladles, but not one ladle, to improve the productivity and recovery of the slab by more than two times.

Although the vertical semi-continuous casting equipment and the vertical semi-continuous casting method using the same have been described with reference to the specific embodiments, they are not limited thereto. Therefore, it will be readily understood by those skilled in the art that various modifications and changes can be made thereto without departing from the spirit and scope of the present invention defined by the appended claims.

What is claimed is:

1. Vertical semi-continuous casting equipment comprising:

a mold capable of cooling molten steel and casting a slab;

an elevatable plate configured to support a lower portion of the slab and draw the slab down from the mold in a direction perpendicular to a ground;

a guide device disposed under the mold and configured to guide a descending slab, wherein the guide device comprises: first guide part and second guide part disposed on both sides of a descending path of the slab, each of the first guide part and the second guide part comprises: a plurality of guide rolls to support and guide the descending slab, and the guide rolls are configured to be rotated by moving force of the descending slab;

a braking unit connected to apply braking force to the guide rolls, wherein the braking unit comprises: a disc connected to and rotating in conjunction with each of the guide rolls; and first pad and second pad configured to move toward or backward from the disc at both sides thereof; and a movement guide device disposed under the mold and extending in the direction perpendicular to the ground, and configured to guide moving of the elevatable plate and the descending slab, wherein the movement guide device comprises: a guide body having an inner space through which the elevatable plate and the descending slab move in the direction perpendicular to the ground; and openings arranged to be spaced apart from each other and in the direction perpendicular to the ground, wherein the first guide part and the second guide part of the guide device are installed at both sides of the movement guide device, respectively, in such a manner that the guide rolls are arranged in correspondence to the openings of the movement guide device, respectively, and wherein the guide rolls of the guide device are configured to move forward and backward from the inner space of the guide body through the openings of the movement guide device.

2. The vertical semi-continuous casting equipment of claim 1, wherein the guide device comprises: a roll driving unit connected to each of the guide rolls to move the guide rolls forward or backward from the inner space of the guide body through the openings of the movement guide device.

3. The vertical semi-continuous casting equipment of claim 2, wherein the roll driving unit comprises:

a support block connected to an end of each of the guide rolls; and a horizontal moving part connected to the support block to move the guide rolls.

4. The vertical semi-continuous casting equipment of claim 1, wherein the openings of the movement guide device comprises: first openings and second openings, and wherein each guide roll of the first guide part is configured to move forward and backward from the inner space of the guide body through the first openings, and each guide roll of the second guide part is configured to move forward and backward from the inner space of the guide body descending slab through the second openings.

5. The vertical semi-continuous casting equipment of claim 1, wherein the guide body comprises:

a first support member and a second support member extending in the direction perpendicular to the ground and facing each other; and a plurality of frames extending in a horizontal direction between the first support member and the second support member, wherein two neighboring frames form each of the openings of the movement guide device, wherein the plurality of frames includes: a plurality of first frames and a plurality of second frames, and the openings of the movement guide device comprises: first openings and second openings, wherein two neighboring first frames form each of the first openings and two neighboring second frames form each of the second openings, and wherein each guide roll of the first guide part is configured to move forward and backward from the inner space of the guide body through the first openings, and each guide roll of the second guide part is configured to move forward and backward from the inner space of the guide body through the second openings.

6. The vertical semi-continuous casting equipment of claim 1, wherein the movement guide device comprises a guide member disposed on an inner surface of the guide body and extending in the direction perpendicular to the ground, the guide member being configured to guide movement of a moving cart to which the elevatable plate is coupled.

7. The vertical semi-continuous casting equipment of claim 1, further comprising: a moving cart disposed in the inner space of the guide body to move the elevatable plate along a guide member provided inside of the guide body.

8. The vertical semi-continuous casting equipment of claim 7, further comprising: a plate moving device connected to the moving cart, wherein the plate moving device comprises:

a rotatable first winch disposed above outside of the movement guide device;

a first wire wound to connect the moving cart and the first winch to each other;

a rotatable first drum around which the first wire wound around the first winch is wound;

a rotatable second winch disposed under the outside of the movement guide device;

a second wire wound to connect the moving cart and the second winch to each other;

a rotatable second drum around which the second wire wound around the second winch is wound.

9. The vertical semi-continuous casting equipment of claim 8, wherein the moving cart comprises:

a cart body on which the elevatable plate is seated on an upper portion thereof;

a pair of rotatable first sheaves disposed to be connected to both side surfaces of the cart body and connected to the first wire;

a pair of rotatable second sheaves disposed on sides of the pair of first sheaves, respectively, and connected to the second wire; and gliding parts mounted on both side surfaces of the cart body, the gliding parts being configured to be glided along the guide member of the movement guide device.

10. The vertical semi-continuous casting equipment of claim 9, wherein the plate moving device further comprises:

a first motor connected to the first drum to rotate the first drum; and a second motor connected to the second drum to rotate the second drum.

11. The vertical semi-continuous casting equipment of claim 1, further comprising:

an unloading device disposed outside the guide body to receive a cast slab, thereby unloading the cast slab through an opening formed at a lower portion of the guide body of the movement guide device, wherein the unloading device comprises: a first seating part configured to support a lower portion of cast slab separated from the elevatable late and a second seating part to support a side surface of the cast slab.

* * * * *